US007153159B2

(12) United States Patent
Burris et al.

(10) Patent No.: US 7,153,159 B2
(45) Date of Patent: Dec. 26, 2006

(54) COAXIAL CABLE CONNECTOR WITH POP-OUT PIN

(75) Inventors: Donald Andrew Burris, Peoria, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/036,443

(22) Filed: Jan. 14, 2005

(65) Prior Publication Data

US 2006/0160416 A1 Jul. 20, 2006

(51) Int. Cl.
*H01R 9/05* (2006.01)

(52) U.S. Cl. ..... 439/578; 439/583

(58) Field of Classification Search ..... 439/578, 439/583, 584, 585
See application file for complete search history.

(56) References Cited

U.S. PATENT DOCUMENTS

| | | | | |
|---|---|---|---|---|
| 3,977,752 | A | 8/1976 | Freitag | |
| 4,289,368 | A | 9/1981 | Schildkraut | |
| 4,342,496 | A | 8/1982 | Hutter et al. | |
| 4,596,435 | A | 6/1986 | Bickford | |
| 4,676,577 | A * | 6/1987 | Szegda | 439/584 |
| 4,854,893 | A * | 8/1989 | Morris | 439/578 |
| 5,011,432 | A * | 4/1991 | Sucht et al. | 439/584 |
| 5,860,833 | A | 1/1999 | Chillscyzn et al. | |
| 6,089,903 | A | 7/2000 | Stafford Gray et al. | |
| 6,089,913 | A | 7/2000 | Holliday | |
| 6,102,738 | A * | 8/2000 | Macek et al. | 439/584 |
| 6,159,046 | A | 12/2000 | Wong | |
| 6,179,656 | B1 | 1/2001 | Wong | |
| 6,293,004 | B1 | 9/2001 | Holliday | |
| 6,352,448 | B1 | 3/2002 | Holliday et al. | |
| 6,884,113 | B1 * | 4/2005 | Montena | 439/578 |
| 2004/0110418 | A1 | 6/2004 | Holliday et al. | 439/585 |
| 2005/0272296 | A1 | 12/2005 | Laverick | 439/353 |

OTHER PUBLICATIONS

Corning Gilbert Inc., UltraSeal Series; "F" Series 7 and 11 Connectors Product Information, published Oct. 2002.
Corning Gilbert Inc., UltraSeal Series; UltraSeal Headend BNC Connector Product Information (GA-BNC-US-59-HEC), published Apr. 2003.
Corning Gilbert Inc., NS-7141-1, mechanical drawing of connector sold by Corning Gilbert Inc. before Jan. 2004.
Corning Gilbert Inc., Installation Instructions for GA-BNC-US-59-HEC, published on or before Apr. 2003.

* cited by examiner

*Primary Examiner*—Thanh-Tam Le
(74) *Attorney, Agent, or Firm*—Joseph M. Homa; Marvin A. Glazer

(57) ABSTRACT

An electrical connector having a front end for attachment to a terminal and a back end for attachment to a coaxial cable includes a body, a post mounted within the body; and a contact assembly movably mounted within the post. The contact assembly includes a guide, a pin mounted to the guide, and a clip mounted to the pin for making electrical and mechanical contact with the center conductor of the coaxial cable. The contact assembly moves longitudinally toward the front end of the connector, such that the front end of the pin moves from a first position completely within the body to a second position at least partially protruding from the body, as the connector receives the coaxial cable. The guide has an opening for the center conductor, which is viewable to a user during attachment until the center conductor enters the opening.

12 Claims, 15 Drawing Sheets

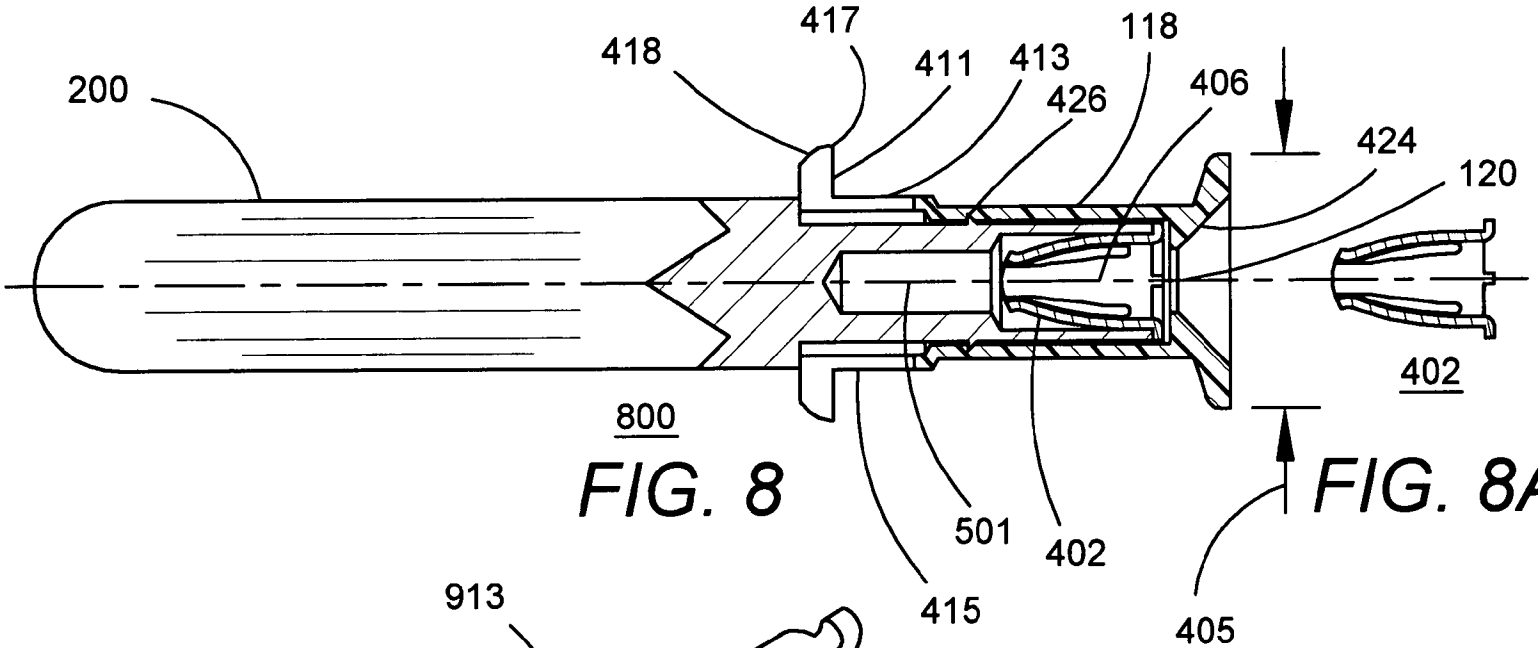
FIG. 8A
FIG. 8
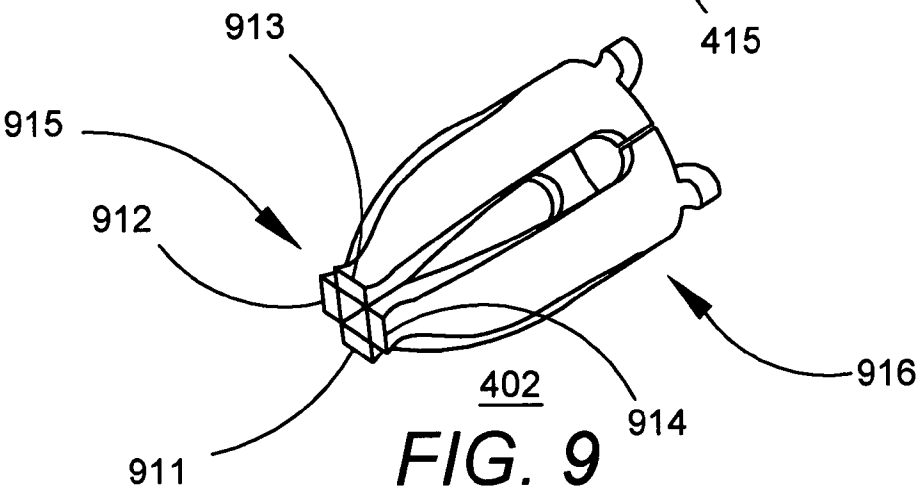
FIG. 9

20A

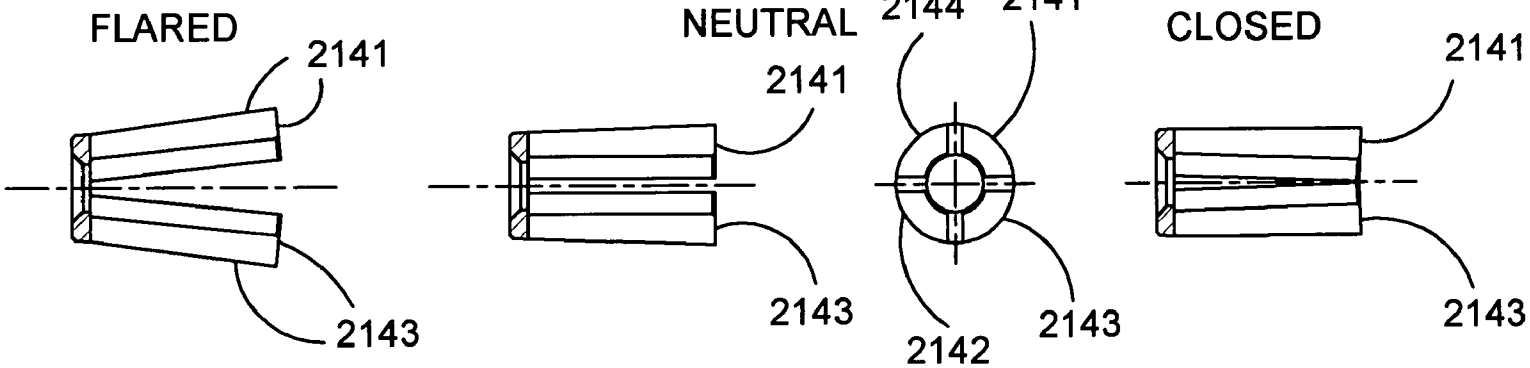
FIG. 26
FIG. 27
FIG. 28
FIG. 29
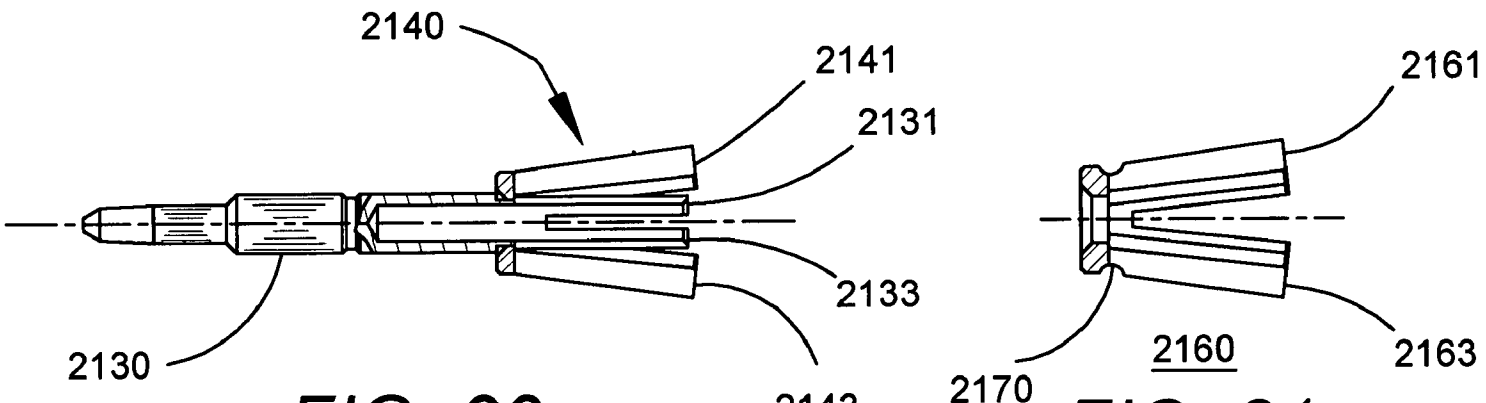
FIG. 30
FIG. 31

COAXIAL CABLE CONNECTOR WITH POP-OUT PIN

BACKGROUND OF THE INVENTION

1. Field of the Invention

This invention relates generally to coaxial cable connectors, and more particularly to coaxial cable connectors capable of being connected to a terminal.

2. Description of the Related Art

Coaxial cable connectors, such as axially-compressible RCA, BNC and F connectors, are used to attach a coaxial cable to another object, such as an appliance or junction, having a terminal adapted to engage the connector. After an end of the coaxial cable is trimmed using one of several known cable preparation techniques, the trimmed end of the coaxial cable is inserted into a back end of the connector. Then, the connector is axially compressed using one of several known installation tools, and the connector and the coaxial cable become permanently attached to each other.

Disadvantageously, most known connectors require "blind entry" of the coaxial cable into the connector, meaning that a small opening in the connector into which it is necessary to insert the center conductor of the coaxial cable becomes blocked from a user's view by a dielectric or jacket of the coaxial cable. The dielectric or jacket blocks the user's view of the small opening primarily because the small opening is disadvantageously recessed too deeply in the connector. Such known connectors provide no means to ensure that the dielectric, or foam core, of the coaxial cable is properly centered within the connector during insertion of the coaxial cable into the connector.

During use, a pin of the RCA and F connectors protrudes from a front end of the connector. However, prior to use, there is no need for the pin to protrude from the connector. Disadvantageously, the pin of many known RCA and F connectors protrudes at all times, including, in particular, during transport or shipment.

Many known connectors utilize separate or loose components that must be manipulated during installation, and, therefore, are subject to loss. For example, a known RCA connector is supplied with a loose pin, meaning that the pin is not integral with the body of the connector, when shipped. The loose pin is subject to loss. Extra manipulation is required to install the separate component.

Another known connector uses the center conductor of the coaxial cable to push out the pin of the connector. Using the center conductor of the coaxial cable to push out the pin does not work well, if at all, when the center conductor is of a small wire gauge.

It is therefore an object of the present invention to provide a coaxial connector that is more "installer friendly" and incorporates a positive visual indication that the connector is properly installed on a coaxial cable.

It is still another object of the present invention to provide a connector that has a pin integral with the body of the connector such that at least part of the pin stays within the body of the connector at all times.

It is still another object of the present invention to provide a connector that has a pin that does not protrude from the connector prior to use.

It is yet another object of the present invention to provide a connector with a one-piece pin and having a positive visual indication that the connector is properly installed on a coaxial cable.

A further object of the present invention is to provide a connector that provides a user with a view of an opening into which the center conductor of a coaxial cable is to be inserted, while the coaxial cable is being inserted into the connector during attachment.

A further object of the present invention is to provide a connector that uses the foam core of the coaxial cable to push out the pin of the connector.

These and other objects of the present invention will become apparent to those skilled in the art as the description thereof proceeds.

SUMMARY OF THE INVENTION

An electrical connector is disclosed herein for attachment to a coaxial cable. The coaxial cable comprises a center conductor and a dielectric layer surrounding the center conductor. The electrical connector comprises: a longitudinal axis; a back end for receiving the coaxial cable; a front end; a body; a post fixedly mounted within the body; and a contact assembly movably mounted to the post, the contact assembly comprising a guide, a pin fixedly mounted to the guide, the pin having a front end and a back end, and a clip for making electrical and mechanical contact with the center conductor of the coaxial cable, the clip being fixedly mounted to a back end of the pin; wherein the contact assembly is capable of moving along the longitudinal axis toward the front end of the electrical connector in response to insertion of the coaxial cable into the back end of the electrical connector, wherein the front end of the pin protrudes from the body when the coaxial cable is fully inserted into the back end of the electrical connector. Preferably, a back side of the guide has an opening at the longitudinal axis for receiving the center conductor of the coaxial cable. In preferred embodiments, the back side of the guide is funnel-shaped to guide the center conductor of the coaxial cable toward the opening in the guide. Preferably, the dielectric layer of the coaxial cable moves the contact assembly. Preferably, the opening in the guide is viewable to a user during attachment until the center conductor of the coaxial cable enters the opening. In preferred embodiments, a back side of the guide is funnel-shaped with an opening at the longitudinal axis for receiving the center conductor of the coaxial cable, such that the dielectric layer, and not the center conductor, of the coaxial cable moves the contact assembly.

In one set of preferred embodiments, an RCA connector is disclosed herein for attachment to a coaxial cable, wherein the coaxial cable comprises a center conductor and a dielectric layer surrounding the center conductor. The electrical connector comprises a longitudinal axis; a back end for receiving the coaxial cable; a front end; a body; a post fixedly mounted within the body; and a contact assembly movably mounted within the post, the body, the post and the contact assembly having a common longitudinal axis, the contact assembly comprising a guide, a pin fixedly mounted to the guide, the pin having a front end and a back end, and a clip for making electrical and mechanical contact with the center conductor of the coaxial cable, the clip being fixedly mounted to a back end of the pin; wherein the contact assembly is capable of longitudinally moving toward the front end of the electrical connector, such that the front end of the pin moves from a first position completely within the body to a second position at least partially protruding from the front end of the body, in response to insertion of the coaxial cable into the back end of the RCA connector.

In another set of preferred embodiments, a BNC connector is disclosed herein for attachment to a coaxial cable, wherein the coaxial cable comprises a center conductor and a dielectric layer surrounding the center conductor. The electrical connector comprises a longitudinal axis; a back end for receiving the coaxial; a front end; a body; a post fixedly mounted within the body; and a contact assembly movably mounted within the post, the body, the post and the contact assembly having a common longitudinal axis, the contact assembly comprising a guide, a pin fixedly mounted to the guide, the pin having a front end and a back end, and a clip for making electrical and mechanical contact with the center conductor of the coaxial cable, the clip being fixedly mounted to a back end of the pin; wherein the contact assembly is capable of longitudinally moving toward the front end of the electrical connector in response to insertion of the coaxial cable into the back end of the BNC connector.

In another set of preferred embodiments, an F connector is disclosed herein for attachment to a coaxial cable, wherein the coaxial cable comprises a center conductor and a dielectric layer surrounding the center conductor. The electrical connector comprises: a longitudinal axis; a back end for receiving the coaxial cable; a front end; a body; a post fixedly mounted within the body; and a contact assembly movably mounted within the post, the body, the post and the contact assembly having a common longitudinal axis, the contact assembly comprising a guide, a pin fixedly mounted to the guide, the pin having a front end and a back end, and a clip for making electrical and mechanical contact with the center conductor of the coaxial cable, the clip being fixedly mounted to a back end of the pin; wherein the contact assembly is capable of longitudinally moving toward the front end of the electrical connector, such that the front end of the pin moves from a first position completely within the body to a second position wherein the pin at least partially protrudes from the front end of the body, in response to insertion of the coaxial cable into the back end of the F connector.

BRIEF DESCRIPTION OF THE DRAWINGS

The present invention will be described with greater specificity and clarity with reference to the following drawings, in which:

FIG. 8 is an enlarged partial cross-sectional view of the contact assembly of the RCA connector of FIG. 4, including a contact, a guide and a spring clip;

FIG. 8A is a cross-sectional view of the spring clip of FIG. 8;

FIG. 9 is a further enlarged, perspective view of the spring clip of FIG. 8A;

FIG. 26 is an enlarged cross-sectional side view of the sabot of the connector of FIG. 21, in a flared state;

FIG. 27 is an enlarged cross-sectional side view of the sabot of the connector of FIG. 21, in a neutral state;

FIG. 28 is an enlarged cross-sectional rear view of the sabot of the connector of FIG. 21, in the neutral state;

FIG. 29 is an enlarged cross-sectional side view of the sabot of the connector of FIG. 21, in a closed state;

FIG. 30 is an enlarged partial cross-sectional view of the contact assembly of the alternative embodiment of the BNC connector of FIG. 21;

FIG. 31 is an enlarged cross-sectional side view of an alternative embodiment of the sabot;

Figure 1:
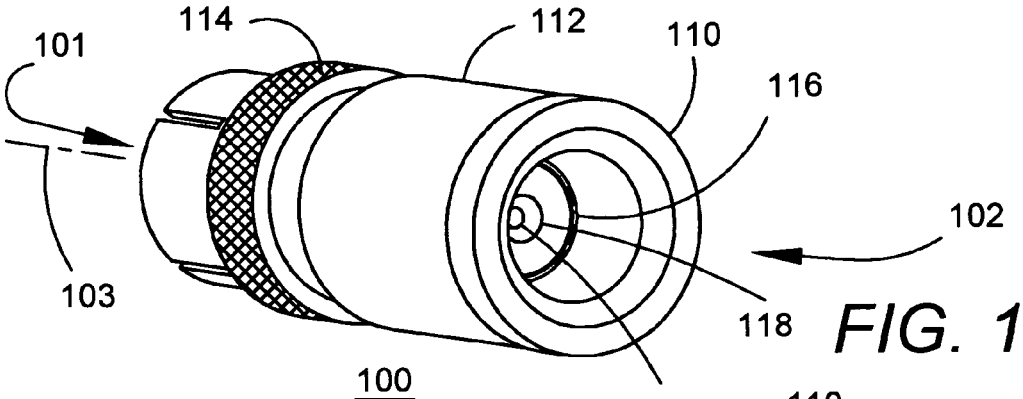
FIG. 1 is a perspective view of an RCA connector disclosed herein showing a back end of the RCA connector, prior to attachment onto a coaxial cable.

For simplicity and clarity of illustration, the drawing figures illustrate the general manner of construction, and descriptions and details of well-known features and techniques are omitted to avoid unnecessarily obscuring the invention. Furthermore, elements in the drawing figures are not necessarily drawn to scale.

DESCRIPTION OF THE PREFERRED EMBODIMENT

FIG. 1 is a perspective view of an axially-compressible RCA connector 100 in accordance with a preferred embodiment of the present invention. FIG. 1 shows the RCA connector 100 prior to attachment together of the RCA connector and a coaxial cable. FIG. 1 shows the RCA connector 100 as it preferably appears prior to use, such as during transport, or shipment, and during storage, hereinafter an "as shipped" state. The RCA connector 100 is generally tubular, and has a front end 101, a back end 102, and a central longitudinal axis 103. The front end 101 is for removable attachment to a terminal (not shown). The back end 102 is for attachment to a coaxial cable. The RCA connector 100 comprises a compression ring 110 that is generally tubular shaped. Preferably, the compression ring 110 is plastic. A tubular shaped shell 112 is mounted to the compression ring 110. Preferably, the shell 112 is metallic. The compression ring 110 is mounted onto a body 114, preferably by a press-fit. Preferably, the body 114 is metallic. A generally tubular shaped post 116 is mounted within the body 114. Preferably, the post 116 is metallic. A generally tubular shaped guide 118 is mounted within the post 116. Preferably, the guide 118 is a dielectric. The compression ring 110, shell 112, body 114, post 116 and guide 118 share the same longitudinal axis 103. A small opening in the guide 118 near the back end 102 of the RCA connector 100 at the longitudinal axis 103 forms a target 120 that is advantageously near the back end 102 of the RCA connector 100.

Figure 2:
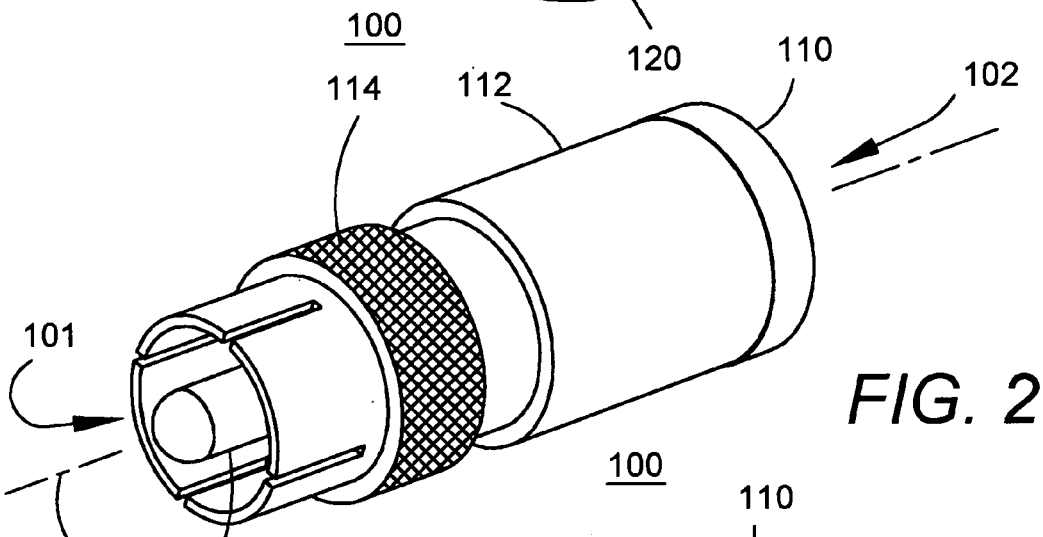
FIG. 2 is a perspective view of the RCA connector of FIG. 1 showing a front end of the RCA connector, prior to attachment of the RCA connector onto a coaxial cable.

FIG. 2 is a perspective view of the RCA connector 100 showing the front end 101 of the RCA connector, prior to attachment together of the RCA connector and a coaxial cable. FIG. 2 shows the RCA connector 100 in the preferred "as shipped" state. The RCA connector 100 includes a pin 200 that is an integral part of the RCA connector, when shipped. Advantageously, the pin 200 does not extend beyond the front end 101 of the RCA connector 100 when in the "as shipped" state. As a result, the body 114 of the RCA connector 100 protects the pin 200 from damage during shipment.

Figure 3:
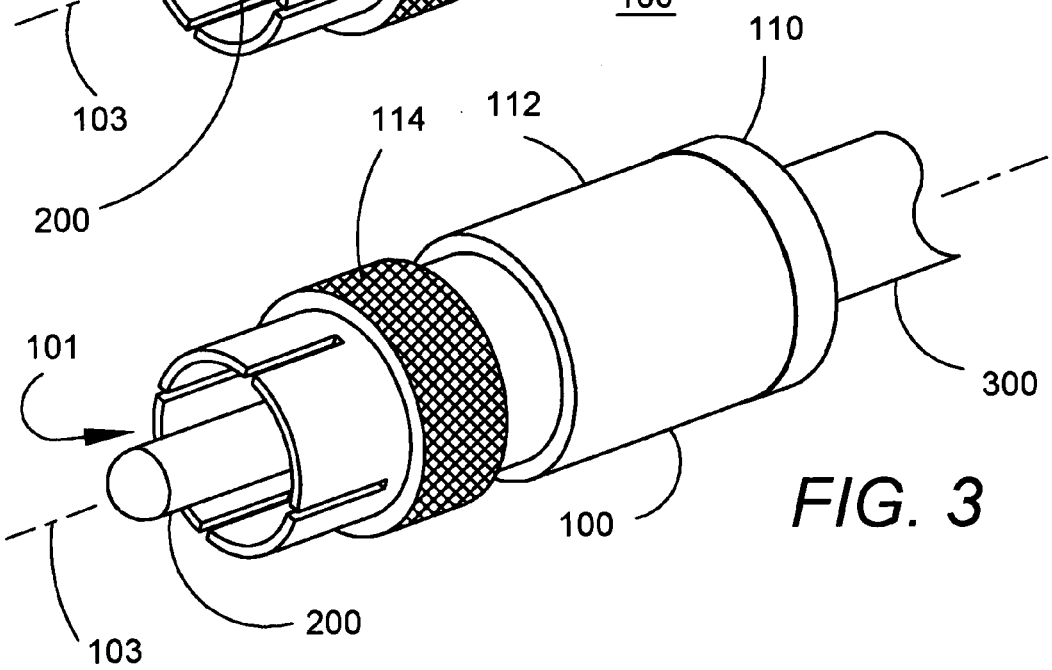
FIG. 3 is a perspective view of the RCA connector of FIG. 1 and a portion of a coaxial cable, showing the front end of the RCA connector, subsequent to attachment of the RCA connector onto the coaxial cable and prior to axial compression.

FIG. 3 is a perspective view of the RCA connector 100 and a portion of a coaxial cable, or cable 300, showing the front end 101 of the RCA connector, subsequent to attachment together of the RCA connector and the cable, and prior to axial compression of the RCA connector. The cable 300 is completely inserted into the RCA connector 100, and the tip or head of the pin 200 is fully extended or fully popped out of the body 114. Advantageously, a user receives a visual indication that the cable 300 is fully inserted into the RCA connector 100 in that the user sees that the pin 200 has moved into a fully popped out position. In FIG. 3, a front portion of the pin 200 extends beyond the front end 101 of the RCA connector 100. In a final step, the RCA connector 100 is axially compressed using one of several standard installation tools, which causes the compression ring 110 and the body 114 to move toward each other, and the attachment is completed. The pin 200 remains in the fully popped out position shown in FIG. 3 after the attachment is completed (see FIG. 7).

Figure 4:
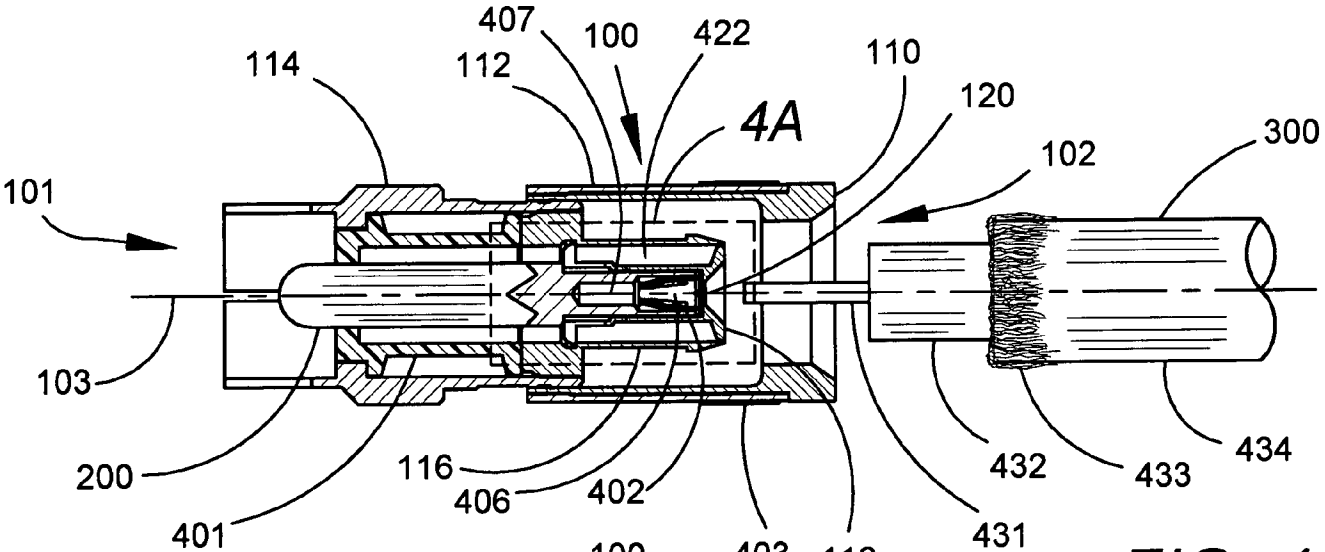
FIG. 4 is a partial cross-sectional view of the RCA connector of FIG. 1 and a side view of a coaxial cable, prior to attachment, including a contact assembly and a post.

FIG. 4 is a partial cross-sectional view of the RCA connector 100 and a side view of the cable 300, prior to attachment together. FIG. 4 shows the RCA connector 100 in the same preferred "as shipped" state as shown in FIG. 2, with a prepared cable 300 ready for insertion. Advantageously, the tip of pin 200 is recessed within the body 114 during shipment. The RCA connector 100 includes an insulator body 401 that supports a front portion of the pin 200 and maintains the pin at the longitudinal axis 103 of the RCA connector 100. The insulator body 401 is a generally tubular support made of electrically insulative material. The pin 200 has an inner surface defining a cylindrical bore along the longitudinal axis 103 of the pin. The bore extends into the pin 200 from the back end of the pin, and the bore has a length approximately one-third the length of the pin. The bore includes a wider portion 406 nearest the back end of the pin 200, and a narrower portion 407 farther from the back end of the pin. The RCA connector 100 includes spring clip, or clip, 402 mounted within the wider portion 406 of the bore. A contact assembly 800 (see FIG. 8) includes the guide 118, the pin 200 and the clip 402. The contact assembly 800 is capable of moving longitudinally, as a unit, relative to the body 114. A label 403 (not indicated in FIG. 1, 2 or 3) is optionally affixed to the outer surface of the shell 112. The cable 300 comprises a center conductor 431, surrounded by a dielectric layer, such as a foam core, 432, surrounded by an outer conductor 433, surrounded by a jacket 434.

Figure 4A:
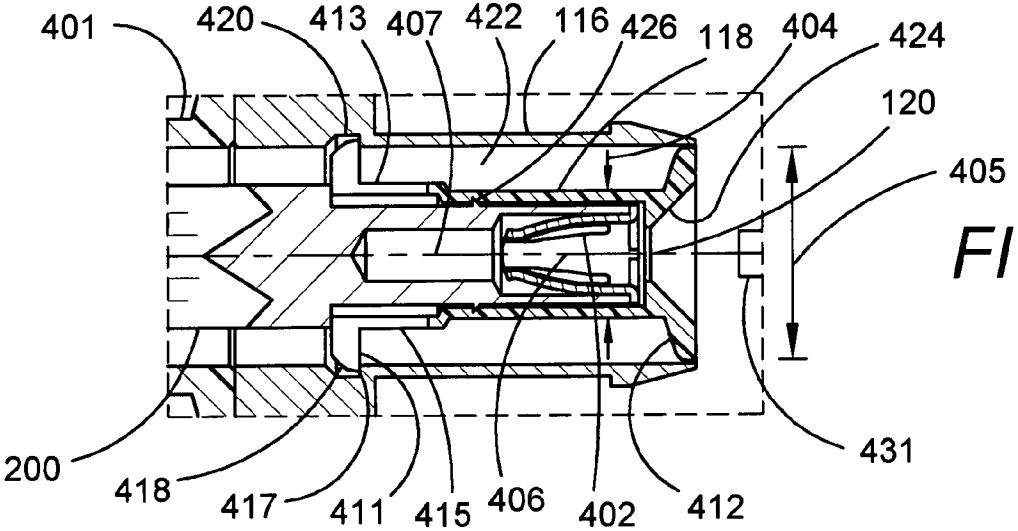
FIG. 4A is an enlargement of Area 4A of FIG. 4.

FIG. 4A is an enlargement of Area 4A of FIG. 4. The post 116 has an inner surface defining a cylindrical bore 422 along the longitudinal axis 103 of the post. The bore 422 extends the length of the post 116. The guide 118 is mounted within the bore 422 of the post 116. The guide 118 includes a middle portion having an outer diameter 404, and integral front and back flanges 411 and 412, each having a larger outer diameter than outer diameter 404, such as outer diameter 405 of the back flange 412. A front portion of the guide 118, including the front flange 411, has a plurality of axial slits forming a plurality of segments. In one preferred embodiment, the front flange 411 has two (2) axial slits, thereby forming four (4) segments. Segments 413 and 415 are visible in FIG. 4A. Preferably, the front flange 411 has a shoulder 417 preferably formed by a sharp corner on a back side of the front flange 411, and a chamfered, tapered or rounded corner 418 on a front side of the front flange. The inner surface of the post 116 is provided with an annular groove 420 preferably in a front portion of the post. An inner wall forming the back side of the groove 420 nearest the back end 102 of the RCA connector 100 preferably is at about a right angle to the inner surface of the post 116. The inner surface of the post 116 forming the side of the groove 420 farthest from the back end 102 is angled to allow the guide 118 to be forced out of and past the groove. The shoulder 417 of the front flange 411 of the guide 118 is capable of engaging the inner surface of the post 116 forming the back side of the groove 420 of the post 116, which engagement prevents the guide from longitudinally sliding or backing out of the RCA connector 100. The corner 418 on the front flange 411 of the guide 118 allows the guide to move forward relative to the post 116 when a sufficient axial force in a forward direction is applied to the guide to cause one or more segments of the front flange 411 to deflect radially inward, thereby allowing the front flange to travel past the front side of the groove 420. A rear portion of the guide 118 preferably includes an angled surface 424, forming a funnel, which aids in the insertion of the center conductor 431 of the cable 300 into the target 120. In preferred embodiments, the guide 118 is machined or molded from a plastic material such as acetal. The location of the guide 118 and pin 200 being near the back end 102 of the RCA connector 100 reduces blind entry of the cable 300. The diametral relationship between the guide 118 and the groove 420 in the post 116 ensures that the guide engages the inner surface of the post 116 and keeps the pin 200 centered in the bore 422 of the post. The larger outer diameter 405 of the back flange 412 is sized to provide centering of the guide 118 in the bore 422 of the post 116. In preferred embodiments, the guide 118 is engaged to the pin 200 by means of a metallic barb 426 in the pin. The metallic barb 426 preferably embeds itself in the relatively pliable guide 118.

Figure 5:
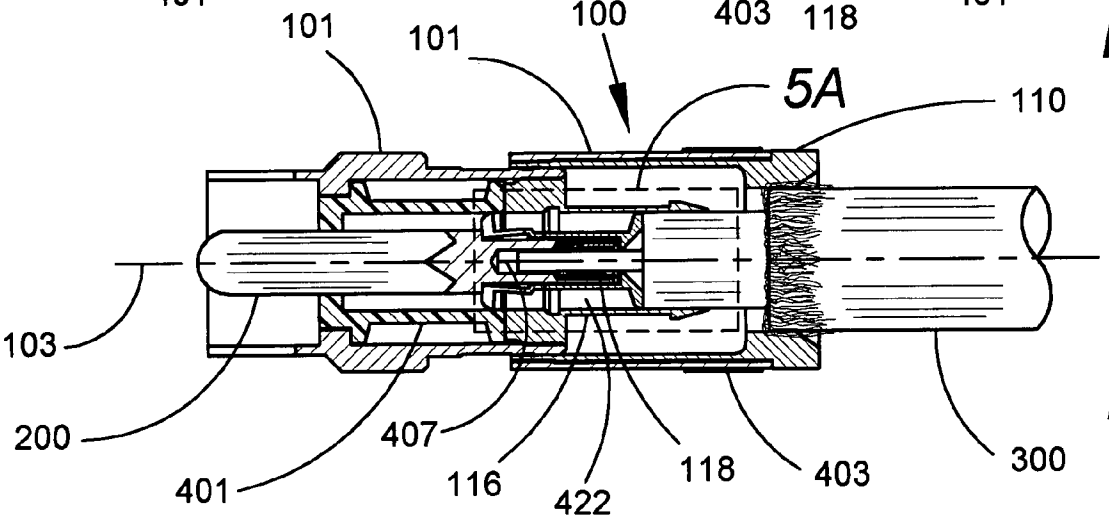
FIG. 5 is a partial cross-sectional view of the RCA connector of FIG. 1 and a side view of the coaxial cable, at a first stage of attachment.

FIG. 5 is a partial cross-sectional view of the RCA connector 100 and a side view of the cable 300, at a first stage of attachment. FIG. 5 shows the cable 300 partially inserted. A tip of the center conductor 431 of the cable 300 has entered the narrower portion 407 of the bore of the pin 200. A standard cable preparation tool exposes the center conductor 431 of the cable 300 a shorter amount than distance 502. As a result, the dielectric layer 432 of the cable 300, and not the center conductor 431 of the cable 300, pushes the contact assembly 800 forward into body 114. In FIG. 5, the contact assembly 800 has been moved forward an intermediate distance as a result of the dielectric layer 432 pushing against the guide 118.

Figure 5A:
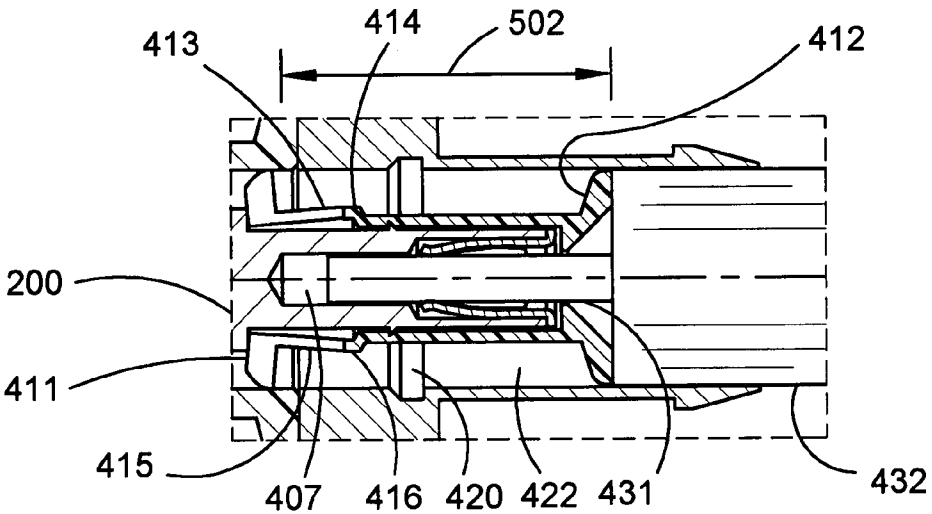
FIG. 5A is an enlargement of Area 5A of FIG. 5.

FIG. 5A is an enlargement of Area 5A of FIG. 5. The four slotted segments (only segments 413 and 415 are shown) of the guide 118 are designed to collapse and bend at bendable points (only bendable points 414 and 416 are shown) during dislodgement, as a result of insertion of the cable 300. The slotted segments of the guide 118 allow the guide to engage the inner surface of the post 116, and also allow the guide to be dislodged from the groove 420 of the post 116 when an appropriate amount of axial force is applied. The front side of the front flange 411 is chamfered and/or radiused to facilitate forward movement of the guide 118 with respect to the post 116, and the back side of the front flange is flat to prevent backward movement of the guide 118 with respect to the post 116.

Figure 6:
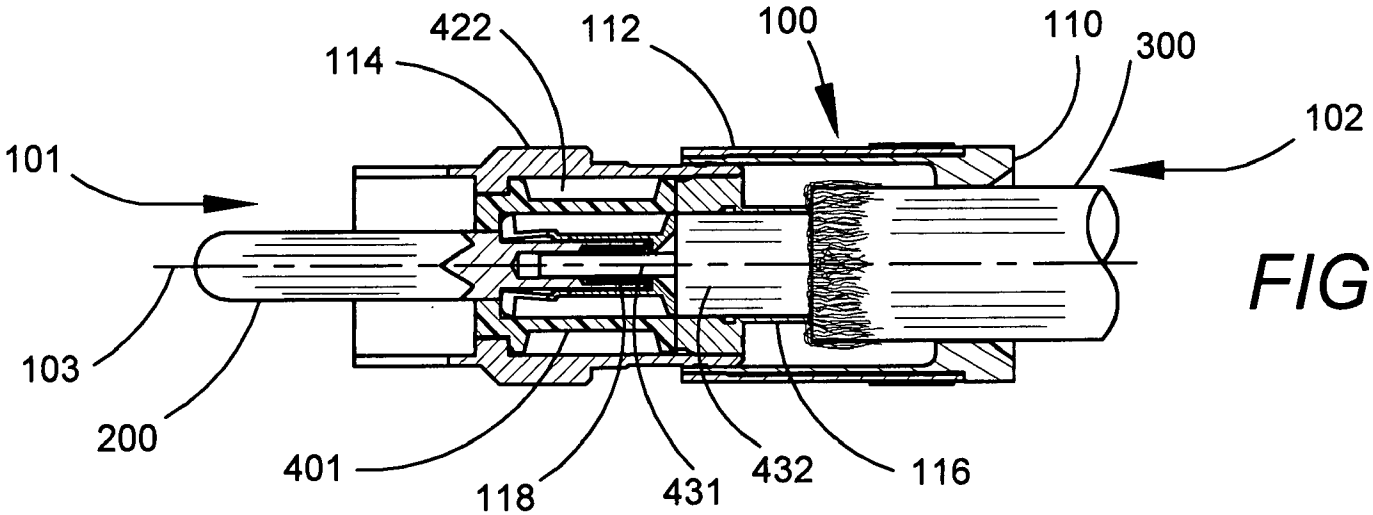
FIG. 6 is a partial cross-sectional view of the RCA connector of FIG. 1 and a side view of the coaxial cable, at a second stage of attachment.

FIG. 6 is a partial cross-sectional view of the RCA connector 100 and a side view of the cable 300 of FIG. 3, and shows a second stage of attachment. FIG. 6 shows the cable 300 fully seated. In FIG. 6, the pin 200 is in a final position, that is, the pin is fully extended or popped out. An advantage of the RCA connector 100 is that proper seating of the cable 300 is indicated by the final position of the pin 200. The pop-out pin 200 provides visual confirmation of proper insertion of the cable 300.

Figure 7:
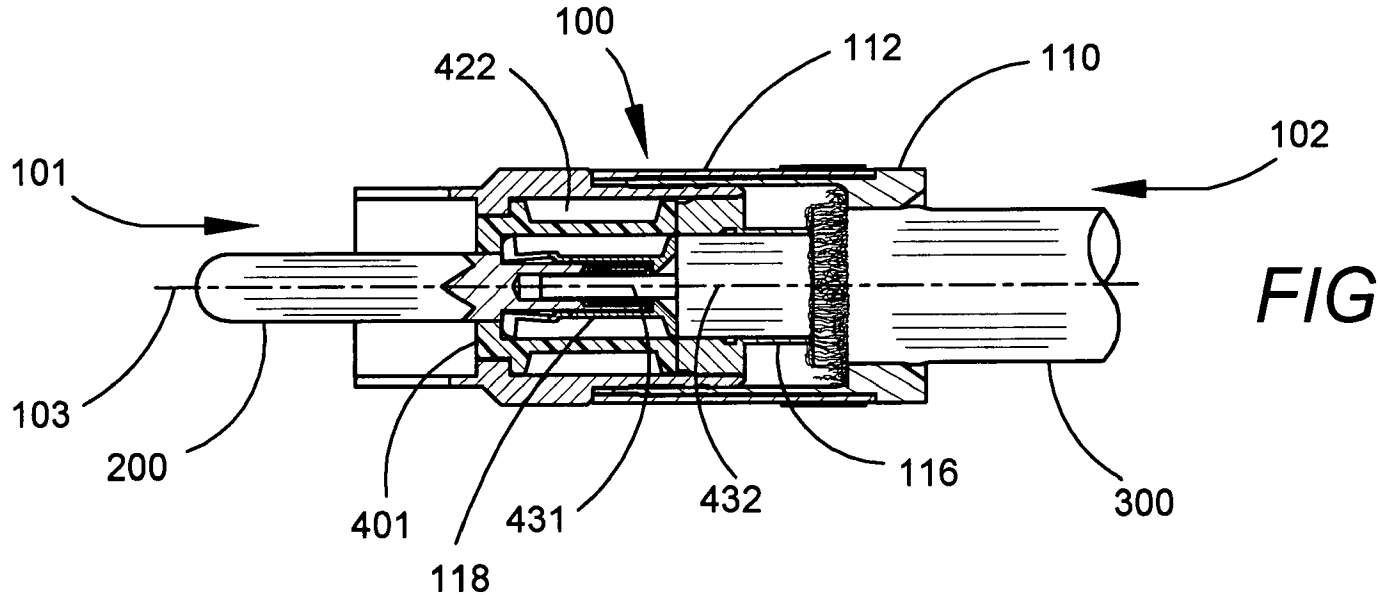
FIG. 7 is a partial cross-sectional view of the RCA connector of FIG. 1 and a side view of the coaxial cable, fully assembled together.

FIG. 7 is a partial cross-sectional view of the RCA connector 100 and the cable 300, assembled together, with the pin 200 remaining in the fully popped out position. FIG. 7 shows the compression ring 110, moved into a closed position, which sandwiches the outer conductor 433 and the jacket 434 of the cable 300 with the post 116. In FIG. 7, the RCA connector 100 is shown in an "in use" state. In FIGS. 6 and 7, a front portion of the pin 200 extends beyond the front end 101 of the RCA connector 100.

FIG. 8 is an enlarged partial cross-sectional view of the contact assembly 800 of the RCA connector 100. FIG. 8A is a cross-sectional view of the clip 402.

FIG. 9 is a further enlarged, perspective view of the clip 402. The clip is mounted, preferably by press-fit, in the wider portion 406 of the bore of the pin 200. The clip 402 includes four (4) tines 911–914 at a front end 915 of the clip 402 each one configured to grip the center conductor 431 of the cable 300 with spring action. A back end 916 of the clip 402 makes contact with the wall of the wider portion 406 of the bore of the pin 200, preferably with a snug fit of the clip within the bore of the pin. Therefore, positive electrical and mechanical engagement is maintained between the pin 200 of the RCA connector 100 and the center conductor 431 of the cable 300 by means of the clip 402. The structure of the guide 118 and the pin 200 is pre-selected to provide a desired impedance range between the body 114 and the pin 200, at a desired radio frequency operating range. The impedance of the connectors in accordance with the invention is nominally 75-ohms. The desired radio frequency operating range of the RCA connector 100 is the audio frequencies. The desired radio frequency operating range of other connectors in accordance with the invention includes frequencies up to 3-GHz.

Figure 10:
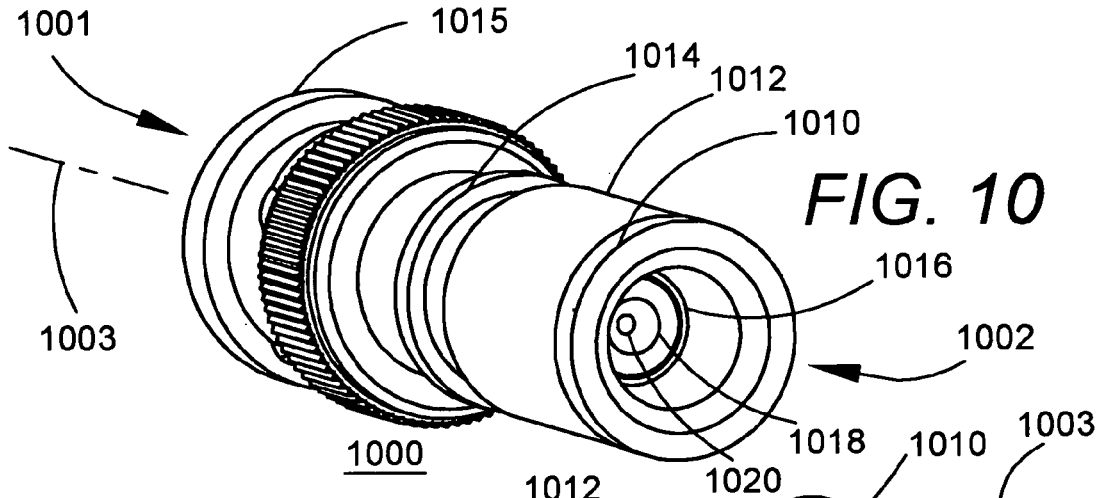
FIG. 10 is a perspective view of a BNC connector disclosed herein showing a back end of the BNC connector, prior to attachment onto a coaxial cable.

FIG. 10 is a perspective view of an axially-compressible BNC connector 1000 showing a back end 1002 of the BNC connector, prior to attachment onto the cable 300. FIG. 10 shows the BNC connector 1000 in the preferred "as shipped" state. The BNC connector 1000 is generally tubular, and has a front end 1001, a back end 1002, and a central longitudinal axis 1003. The front end 1001 is for removable attachment to a terminal (not shown). The back end 1002 is for attachment onto a cable. The BNC connector 1000 comprises a compression ring 1010 that is generally tubular shaped. A tubular shaped shell 1012 is mounted to the compression ring 1010. The compression ring 1010 is mounted onto a body 1014, preferably by a press-fit. Preferably, the compression ring 1010 is plastic, and the shell 1012 and the body 1014 are metallic. A bayonet coupler 1015, including a gasket 1017 and a pair of washers 1021 and 1022, is snap-fit mounted onto the front end 1001 of the body 1014. The gasket 1017 is preferably polypropylene. The bayonet coupler 1015 and the washers 1021 and 1022 are preferably metallic. A coil spring 1025 is mounted between the pair of washers 1021 and 1022. The coil spring 1025 is preferably metallic. A generally tubular shaped post 1016 is mounted within the body 1014. Preferably, the post is metallic. A generally tubular shaped guide 1018 is mounted within the post 1016. Preferably, the guide 1018 is a dielectric. The compression ring 1010, shell 1012, body 1014, post 1016 and guide 1018 share the same longitudinal axis 1003.

Figure 11:
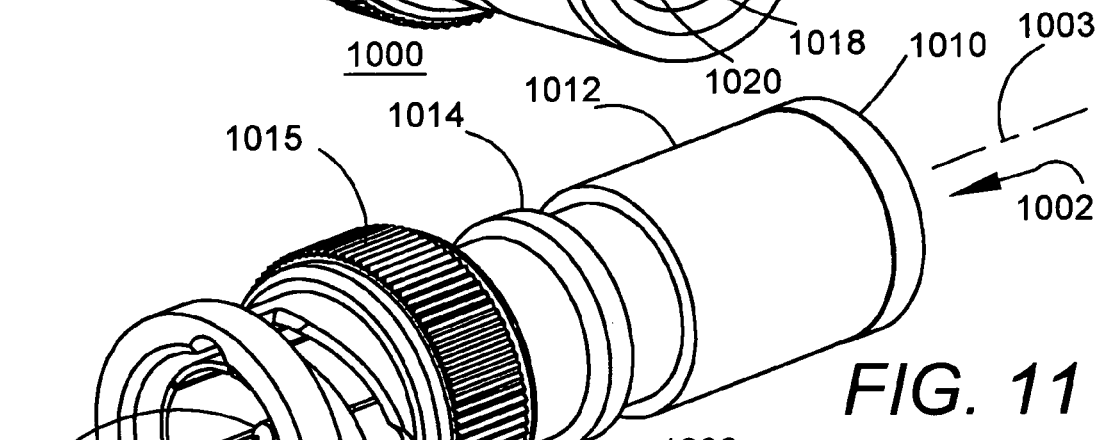
FIG. 11 is a perspective view of the BNC connector of FIG. 10 showing a front end of the BNC connector, prior to attachment of the BNC connector onto a coaxial cable.

FIG. 11 is a perspective view of the BNC connector 1000 showing a front end 1001 of the BNC connector, prior to attachment of the BNC connector onto the cable 300. FIG. 11 shows the BNC connector 1000 in the preferred "as shipped" state. The BNC connector 1000 includes a pin 1100 that is an integral part of the BNC connector, when shipped. In preferred embodiments, the pin 1100 does not extend close to the front end 1001 of the BNC connector 1000 such that the body 1014 of the BNC connector 1000 protects the pin 1100 from damage during shipment.

Figure 12:
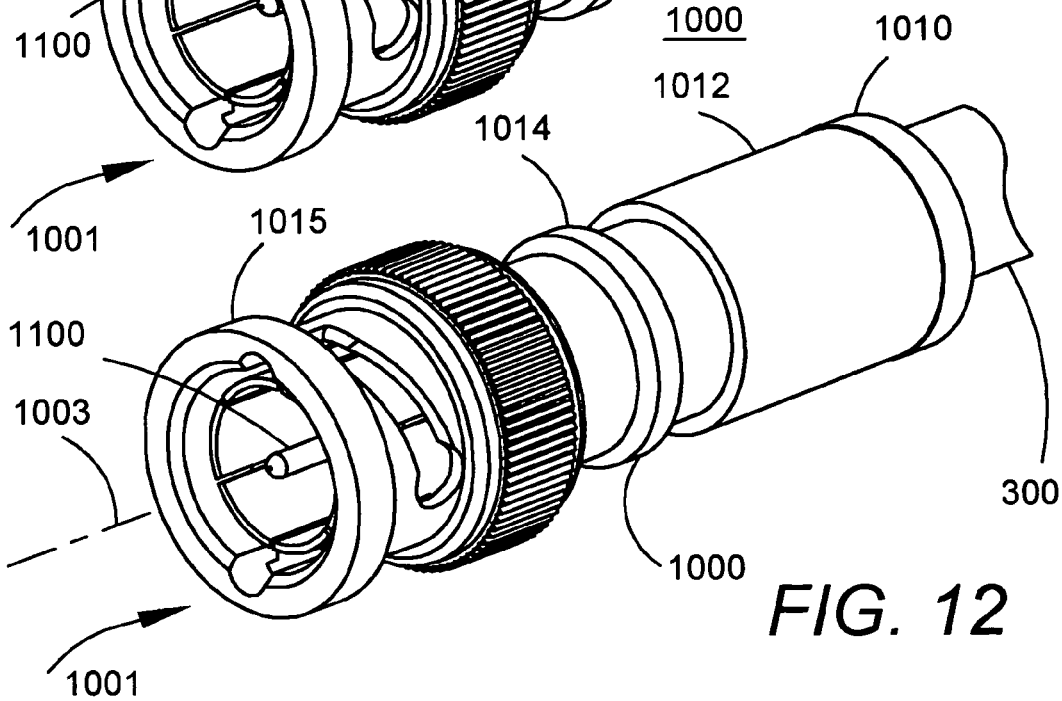
FIG. 12 is a perspective view of the BNC connector of FIG. 10 and a portion of a coaxial cable, showing the front end of the BNC connector, subsequent to attachment of the BNC connector onto the coaxial cable.

FIG. 12 is a perspective view of the BNC connector 1000 and a portion of the coaxial cable 300, showing the front end 1001 of the BNC connector, subsequent to attachment of the BNC connector onto the cable 300, and prior to axial compression of the BNC connector. The cable 300 is completely inserted into the BNC connector 1000, and the pin 1100 is fully extended or popped out of the body 1014. Advantageously, a user receives a visual indication that the cable 300 is fully inserted into the BNC connector 1000 in that the user sees that the pin 1100 has moved to a fully popped out position. In FIG. 12, the pin 1100 has moved closer to the front end 1001 of the BNC connector 1000. In a final step, the BNC connector 1000 is axially compressed using one of several standard installation tools, which causes the compression ring 1010 and the body 1014 to move toward each other, and the attachment is completed. The pin 1100 remains in the fully popped out position shown in FIG. 12 after the attachment is completed (see FIG. 16).

Figure 13:
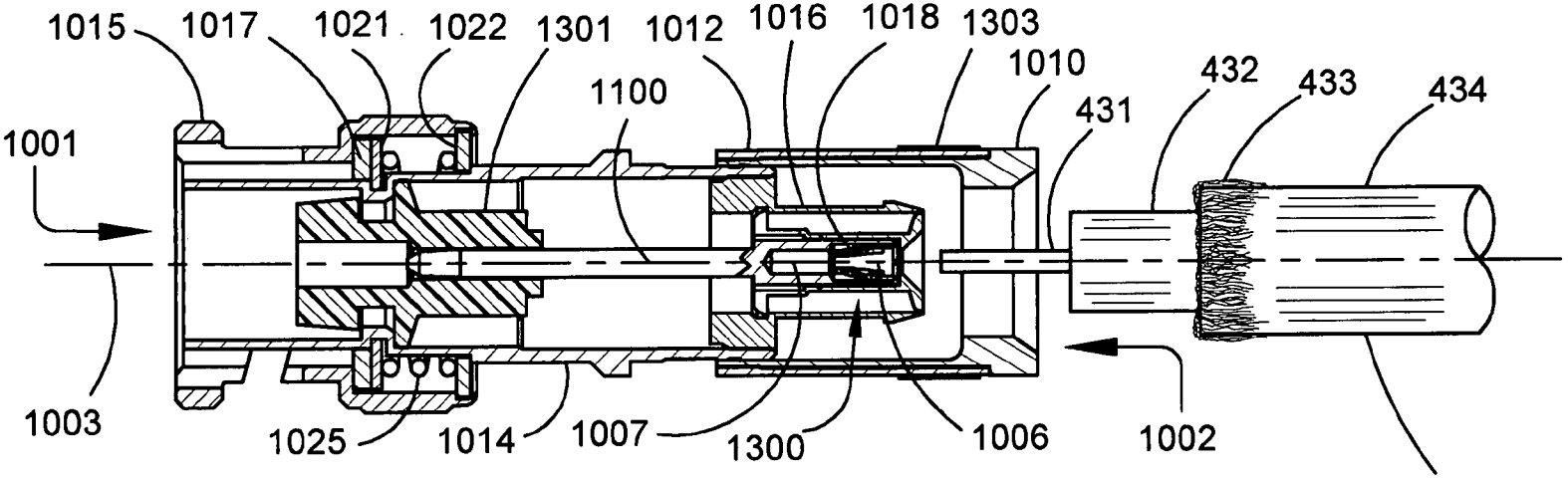
FIG. 13 is a partial cross-sectional view of the BNC connector of FIG. 10 and a side view of a coaxial cable, prior to attachment.

FIG. 13 is a partial cross-sectional view of the BNC connector 1000 and a side view of the cable 300, prior to attachment together. The cross-sectional view of FIG. 13 shows the BNC connector 1000 in the same preferred "as shipped" state as shown in the perspective view of FIG. 11, with a prepared cable 300 ready for insertion. In preferred embodiments, the pin 1100 is recessed within the body 1014. The BNC connector 1000 includes an insulator body 1301 that supports a front portion of the pin 1100 and maintains the pin at the central longitudinal axis 1003 of the BNC connector 1000. Preferably, the insulator body 1301 is a generally tubular support made of electrically insulative material. The pin 1100 has an inner surface defining a cylindrical bore along the longitudinal axis 1003 of the pin. The bore extends into the pin 1100 from the back end of the pin, and the bore has a length approximately one-third the length of the pin. In a preferred embodiment, the bore includes a wider portion 1006 nearest the back end of the pin 1100, and a narrower portion 1007 farther from the back end of the pin. The BNC connector 1000 includes the clip 402 mounted within the wider portion 1006 of the bore of the pin 1100. A contact assembly 1300 includes the guide 1018, the pin 1100 and the clip 402. The contact assembly 1300 is capable of moving longitudinally, as a unit, relative to the body 114. A label 1303 (not indicated in FIG. 10, 11 or 12) is optionally affixed to the outer surface of the shell 1012.

Figure 14:
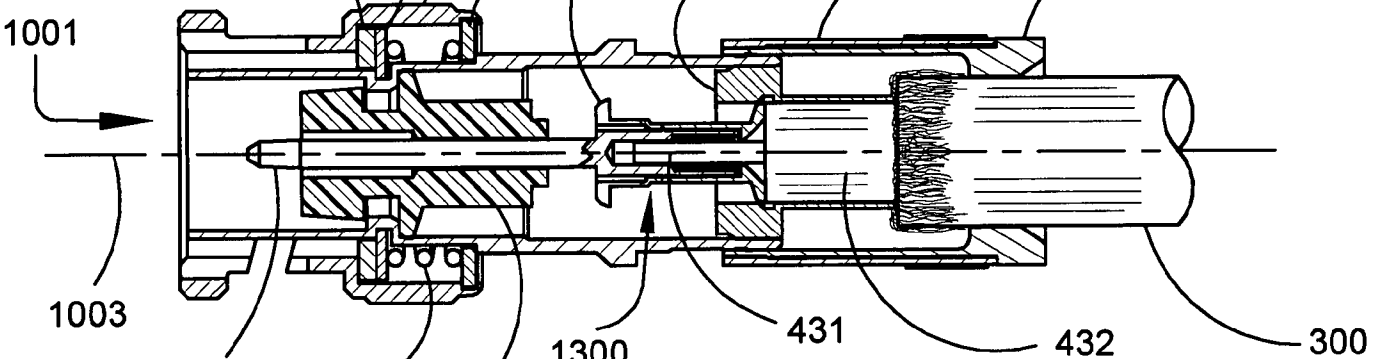
FIG. 14 is a partial cross-sectional view of the BNC connector of FIG. 10 and a side view of the coaxial cable, at a first stage of attachment.

FIG. 14 is a partial cross-sectional view of the BNC connector 1000 and a side view of the cable 300, at a first stage of attachment. FIG. 14 shows the cable 300 partially inserted into the BNC connector 1000. The tip of the center conductor 431 of the cable 300 has entered the narrower portion 1007 of the bore of the pin 1100. Advantageously, a standard cable preparation tool is used to prepare the cable 300 such that the dielectric layer 432 of the cable 300, and not the center conductor 431 of the cable 300, pushes the contact assembly 1300 forward into the body 1014. In FIG. 14, the contact assembly 1300 has been moved forward an intermediate distance as a result of the dielectric layer 432 pushing against the guide 1018.

Figure 15:
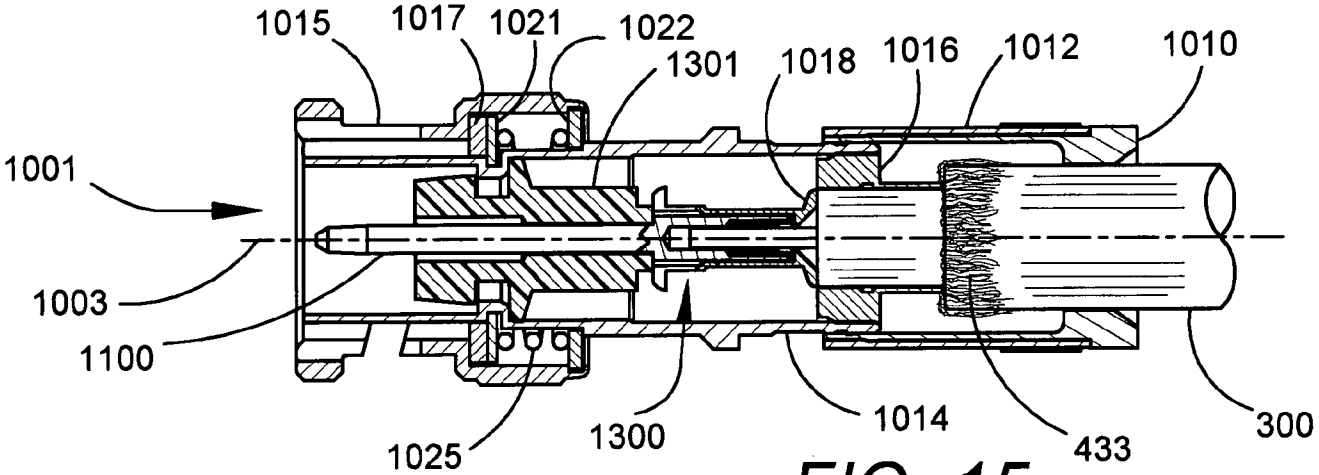
FIG. 15 is a partial cross-sectional view of the BNC connector of FIG. 10 and a side view of the coaxial cable, at a second stage of attachment.

FIG. 15 is a partial cross-sectional view of the BNC connector 1000 and the cable 300, at a second stage of attachment. FIG. 15 shows the cable 300 fully seated. In FIG. 13, the pin 1100 is in a final position, that is, the pin is fully popped out. An advantage of the BNC connector 1000 is that proper seating of the cable 300 is confirmed by the final position of the pin 1100. The pop-out pin 1100 provides visual confirmation of proper insertion of the cable 300.

Figure 16:
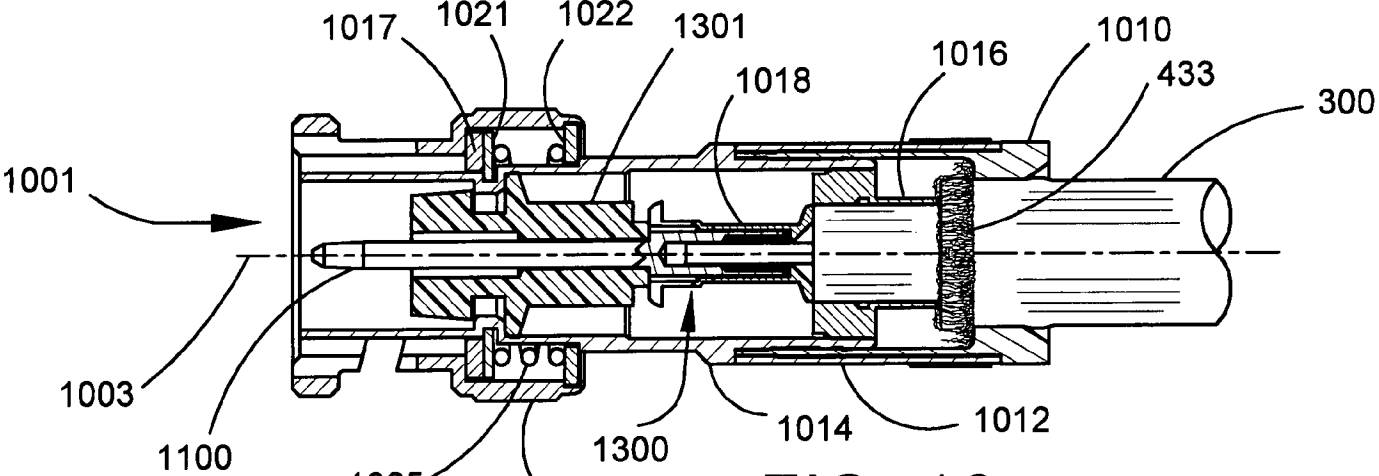
FIG. 16 is a partial cross-sectional view of the BNC connector of FIG. 10 and a side view of the coaxial cable, fully assembled together.

FIG. 16 is a partial cross-sectional view of the BNC connector 1000 and a side view of the cable 300, attached together, with the pin 1100 remaining in the fully popped out position. FIG. 16 shows the compression ring 1010, moved into the closed position, which captures the outer conductor 433 and jacket 434 of the cable 300 between the compression ring 1010 and the post 1016. In FIG. 16, the BNC connector 1000 is shown in the "in use" state.

Figure 17:
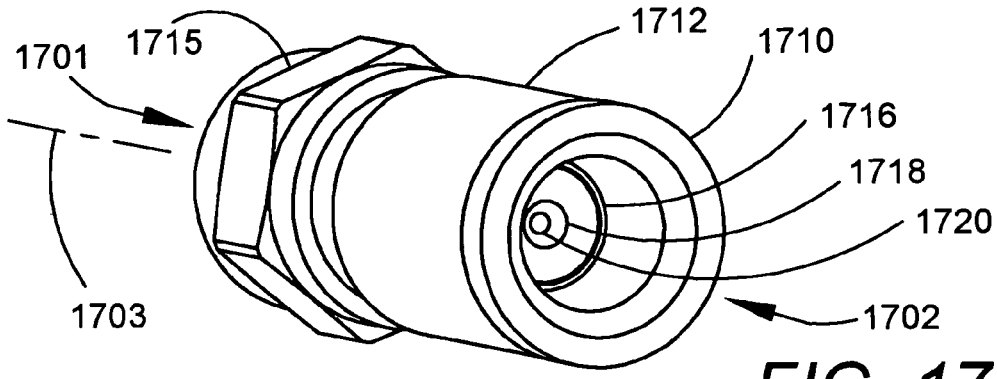
FIG. 17 is a perspective view of an F connector disclosed herein showing a back end of the F connector, prior to attachment onto a coaxial cable.

FIG. 17 is a perspective view of an axially-compressible F connector 1700 showing a back end 1702 of the F connector prior to attachment together of the F connector and the cable 300. FIG. 17 shows the F connector 1700 in the preferred "as shipped" state. The F connector 1700 is generally tubular, and has a front end 1701, a back end 1702, and a central longitudinal axis 1703. The front end 1701 is for removable attachment to a terminal (not shown). The back end 1702 is for attachment onto the cable 300. The F connector 1700 comprises a compression ring 1710 that is generally tubular shaped. Preferably, the compression ring 1710 is plastic, and more preferably, is molded acetal. A tubular shaped shell 1712 is mounted to the compression ring 1710. Preferably, the shell 1712 is metallic. The compression ring 1710 is mounted onto a body 1714, preferably by a press-fit. Preferably, the body 1714 is metallic. A generally tubular shaped post 1716 is mounted within the body 1714. Preferably, the post is metallic. A generally tubular shaped guide 1718 is mounted within the post 1716. Preferably, the guide 1718 is a dielectric. The compression ring 1710, shell 1712, body 1714, post 1716 and guide 1718 share the same longitudinal axis 1703.

Figure 18:
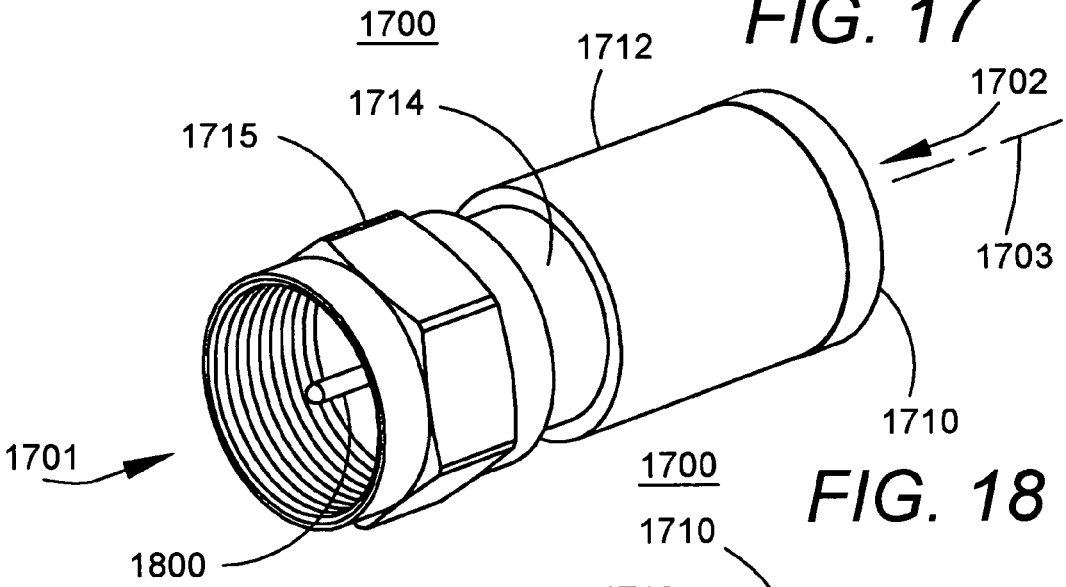
FIG. 18 is a perspective view of the F connector of FIG. 17 showing a front end of the F connector, prior to attachment of the F connector onto a coaxial cable.

FIG. 18 is a perspective view of the F connector 1700 showing a front end 1701 of the F connector, prior to attachment of the F connector onto the cable 300. FIG. 18 shows the F connector 1700 in the preferred "as shipped" state. The F connector 1700 includes a pin 1800 that is an integral part of the F connector, when shipped. Advantageously, the pin 1800 does not extend beyond the front end 1701 of the F connector 1700 during shipment. As a result, the body 1714 of the F connector 1700 protects the pin 1800 from damage.

Figure 19:
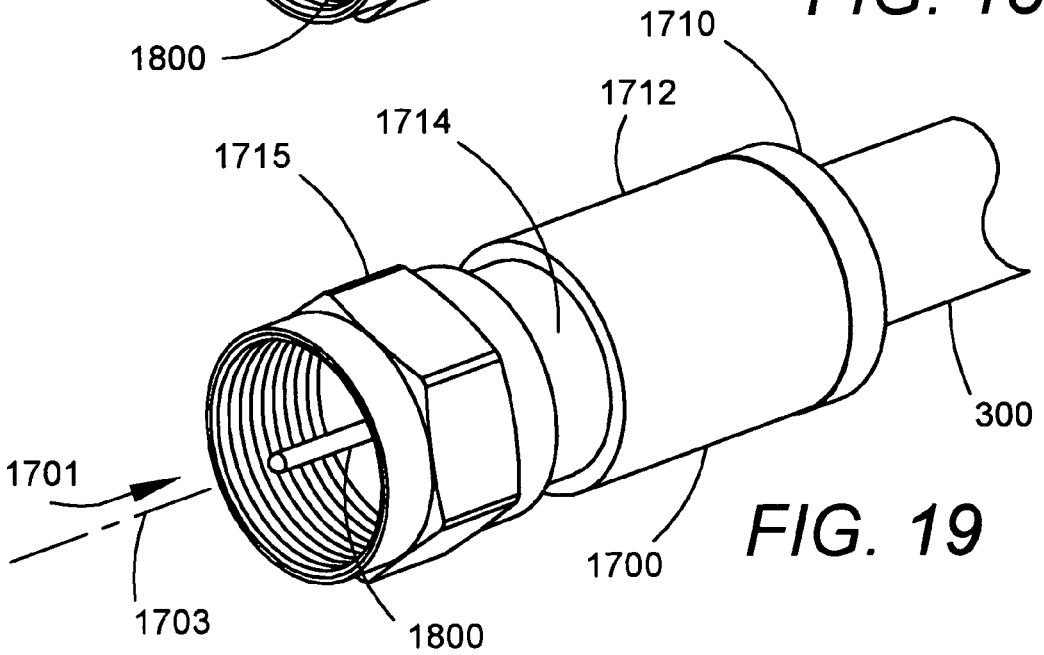
FIG. 19 is a perspective view of the F connector of FIG. 17 and a portion of a coaxial cable, showing the front end of the F connector, subsequent to attachment of the F connector onto the coaxial cable.

FIG. 19 is a perspective view of the F connector 1700 and a portion of the cable 300, showing the front end 1701 of the F connector, subsequent to attachment together of the F connector and the cable, and prior to axial compression of the F connector. The cable 300 is completely inserted into the F connector 1700, and the tip or head of pin 1800 is fully extended or fully popped out of the body 1714. Advantageously, a user receives a visual indication that the cable 300 is fully inserted into the F connector 1700 in that the user sees that the pin 1800 has moved to a fully popped out position. In FIG. 19, a front portion of the pin 1800 extends beyond the front end 1701 of the F connector 1700. In a final step, the F connector 1700 is axially compressed using one of several standard installation tools, which causes the compression ring 1710 and the body 1714 to move toward each other, thereby completing the attachment, and the F connector 1700 enters the "in use" state (not shown). The pin 1800 remains in the fully popped out position shown in FIG. 19 after the attachment is completed.

Figure 20A:
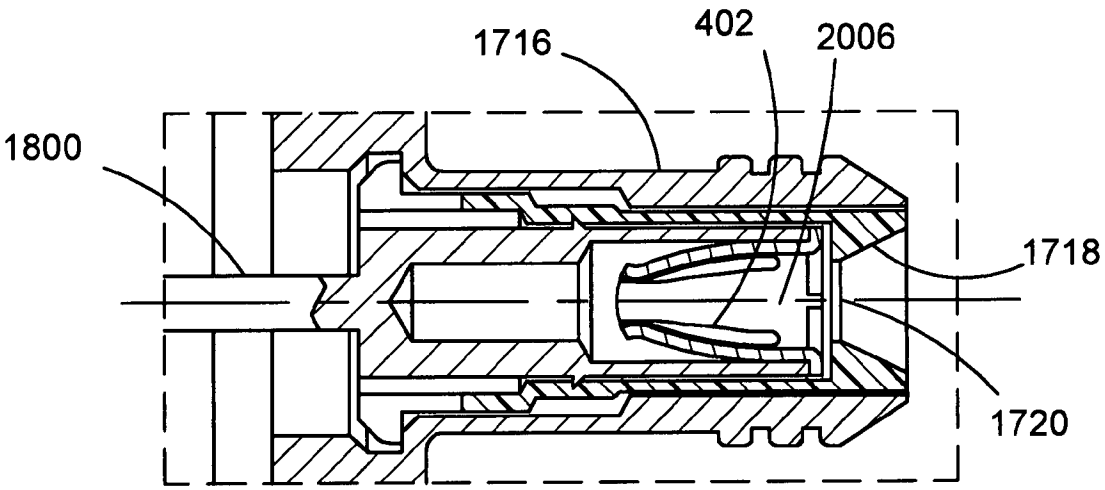
FIG. 20A is an enlargement of Area 20A of FIG. 20.
Figure 20:
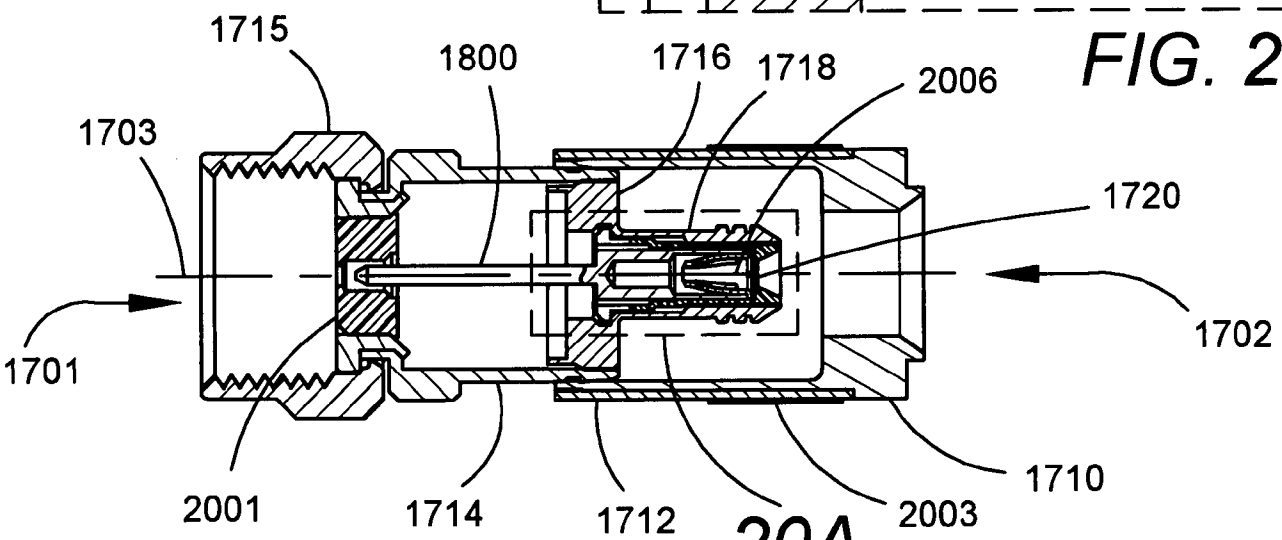
FIG. 20 is a partial cross-sectional view of the F connector of FIG. 17.

FIG. 20 is a partial cross-sectional view of the F connector 1700 in the same preferred "as shipped" state as shown in the perspective view of FIG. 17, with a prepared cable 300 ready for insertion. Advantageously, the tip of pin 1800 is recessed within the body 1714 during shipment. The F connector 1700 includes an insulator body 2001 that supports a front portion of the pin 1800 and maintains the pin 1800 at the longitudinal axis 1703 of the F connector 1700. Preferably, the insulator body 2001 is a generally tubular support made of electrically insulative material. The F connector 1700 includes the clip 402 mounted within a wider portion 2006 of a bore at the back end of the pin 1800. A contact assembly includes the guide 1718, the pin 1800 and the clip 402. The contact assembly is capable of moving longitudinally, as a unit, relative to the body 1714. A label 2003 (not indicated in FIG. 17, 18 or 19) is optionally affixed to the outer surface of the shell 1712. FIG. 20A is an enlargement of Area 20A of FIG. 20, and shows the contact assembly.

Figure 21:
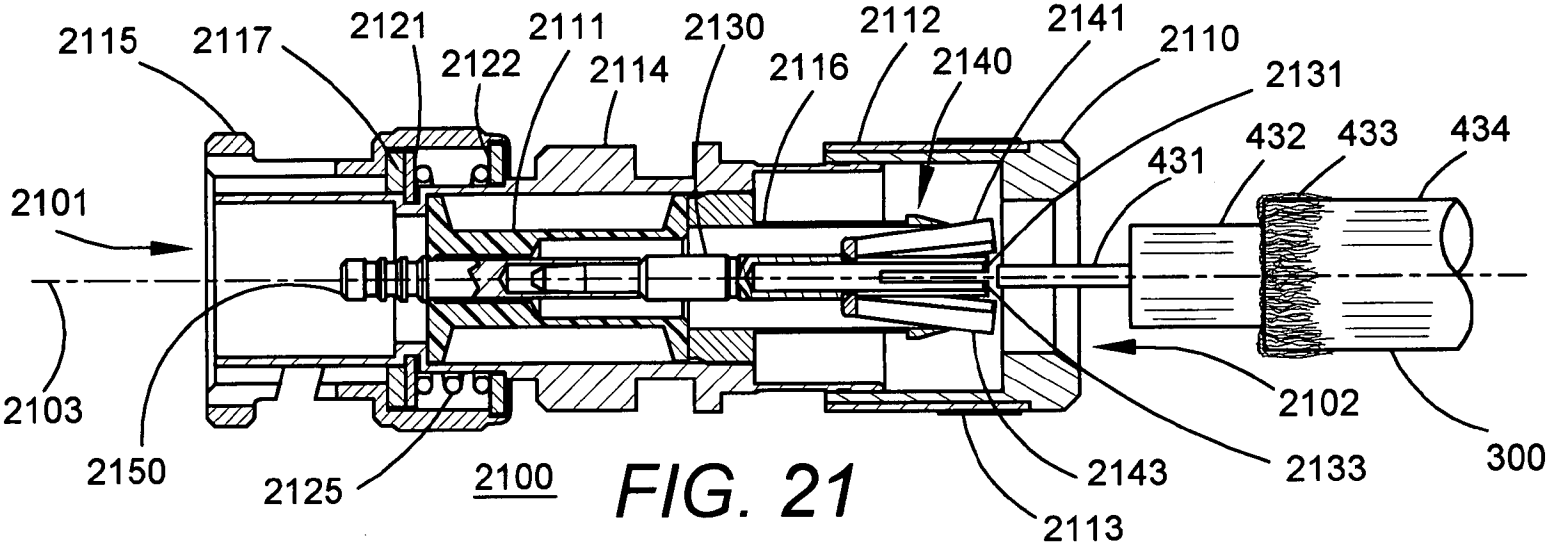
FIG. 21 is a partial cross-sectional view of an alternative embodiment of a BNC connector having a sabot, and a side view of a coaxial cable, shown prior to attachment to the coaxial cable.

FIGS. 21–25 show another embodiment of a BNC connector 2100 with an alternative embodiment of a pop up pin 2130 with an attached sabot 2140. FIG. 21 is a partial cross-sectional view the BNC connector 2100 and a side view of the cable 300, prior to attachment to each other. FIG. 21 shows the BNC connector 2100 in the preferred "as shipped" state, with a prepared cable 300 ready for insertion. The sabot 2140 helps reduce the effect of cable "blind entry".

Figure 22:
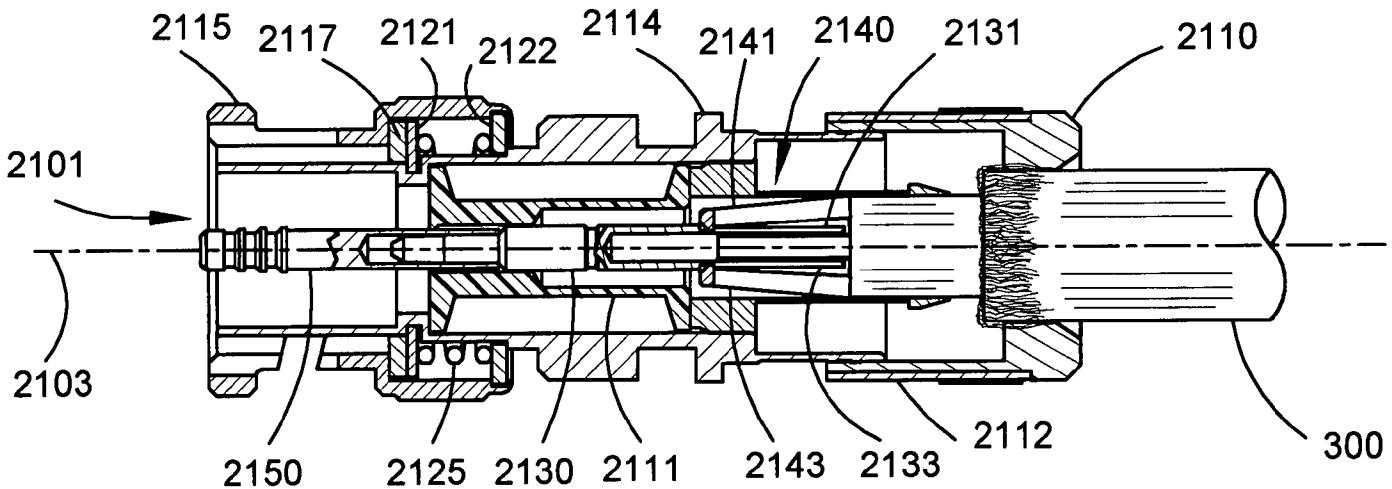
FIG. 22 is a partial cross-sectional view of the alternative embodiment of the BNC connector of FIG. 21 and a side view of the coaxial cable, at a first stage of attachment.

FIG. 22 is a partial cross-sectional view of the alternative embodiment of the BNC connector 2100 and a side view of the cable 300, at a first stage of attachment. FIG. 22 shows the cable 300 partially inserted. The sabot 2140 acts as a guide for the dielectric layer 432 of the cable 300 to enter the inner diameter of the post 2116. As the pin 2130 (and the sabot 2140) are axially advanced into the post 2116 by the cable 300, the post engages the sabot, and the sabot hinges inward toward the longitudinal axis 2103 such that the sabot 2140 is partially closed by the inner diameter of the post 2116. The sabot 2140 acts as a guide for the dielectric layer 432 of the cable 300 to enter the inner diameter of the post 2116. Disposable front guide 2150 maintains alignment of the pin 2130 within the post 2116. Proper seating of the cable 300 can be confirmed by a final position of the pin 2130. The pop-out pin 2130 provides visual confirmation of proper installation of the cable 300.

Figure 23:
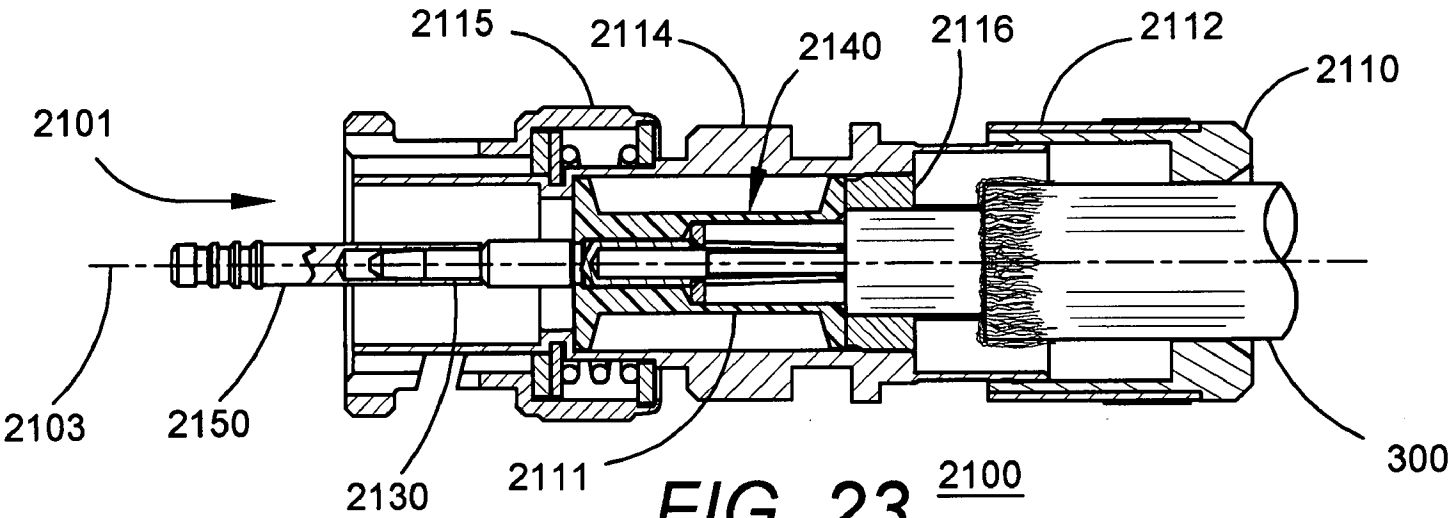
FIG. 23 is a partial cross-sectional view of the alternative embodiment of the BNC connector of FIG. 21 and a side view of the coaxial cable, at a second stage of attachment.

FIG. 23 is a partial cross-sectional view of the alternative embodiment of the BNC connector 2100 and a side view of the cable 300, at a second stage of attachment. FIG. 23 shows the cable 300 fully seated. The arms 2141–2144 of the sabot 2140 are radially displaced inwardly within the bore of the connector insulator 2111, causing the four metallic fingers (only finger 2131 and finger 2133 are shown) at the back end of the slotted pin 2130 to close around, and preferably on, the center conductor 431 of the cable 300.

Figure 24:
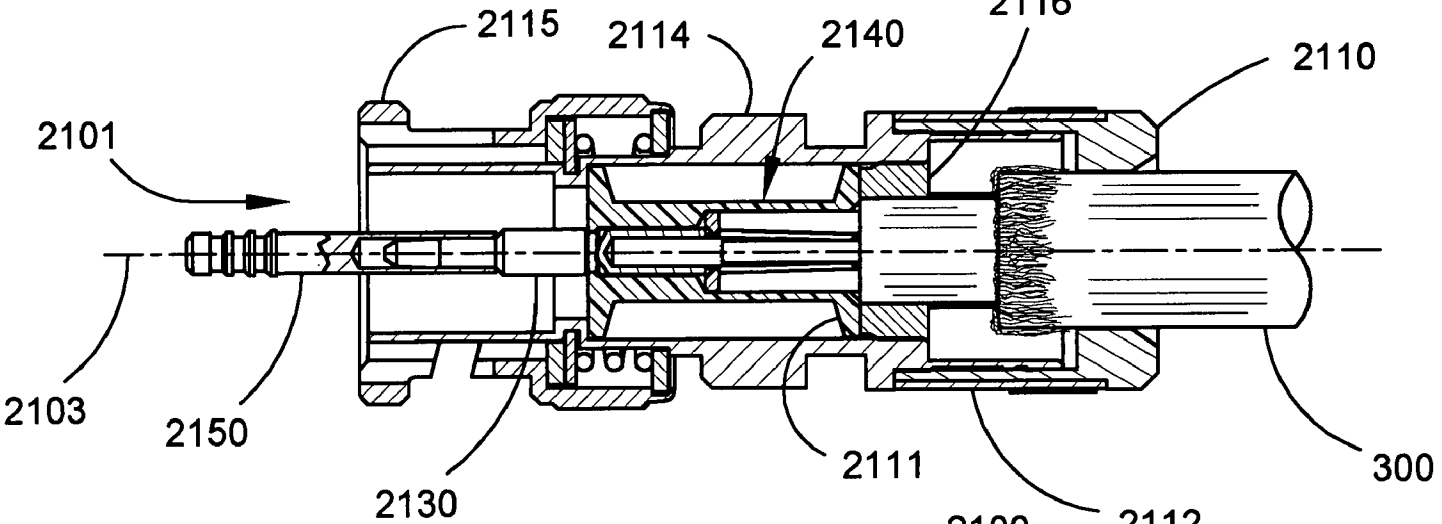
FIG. 24 is a partial cross-sectional view of the alternative embodiment of the BNC connector of FIG. 21 and a side view of the coaxial cable, at a third stage of attachment.

FIG. 24 is a partial cross-sectional view of the alternative embodiment of the BNC connector 2100 and a side view of the cable 300, at a third stage of attachment. FIG. 24 shows the compression ring 2110, moved into the closed position, which captures the outer conductor 433 and the jacket 434 of the cable 300 between the compression ring 2110 and the post 2116. At this point in the attachment process, the disposable front guide 2150 can be removed and discarded.

Figure 25:
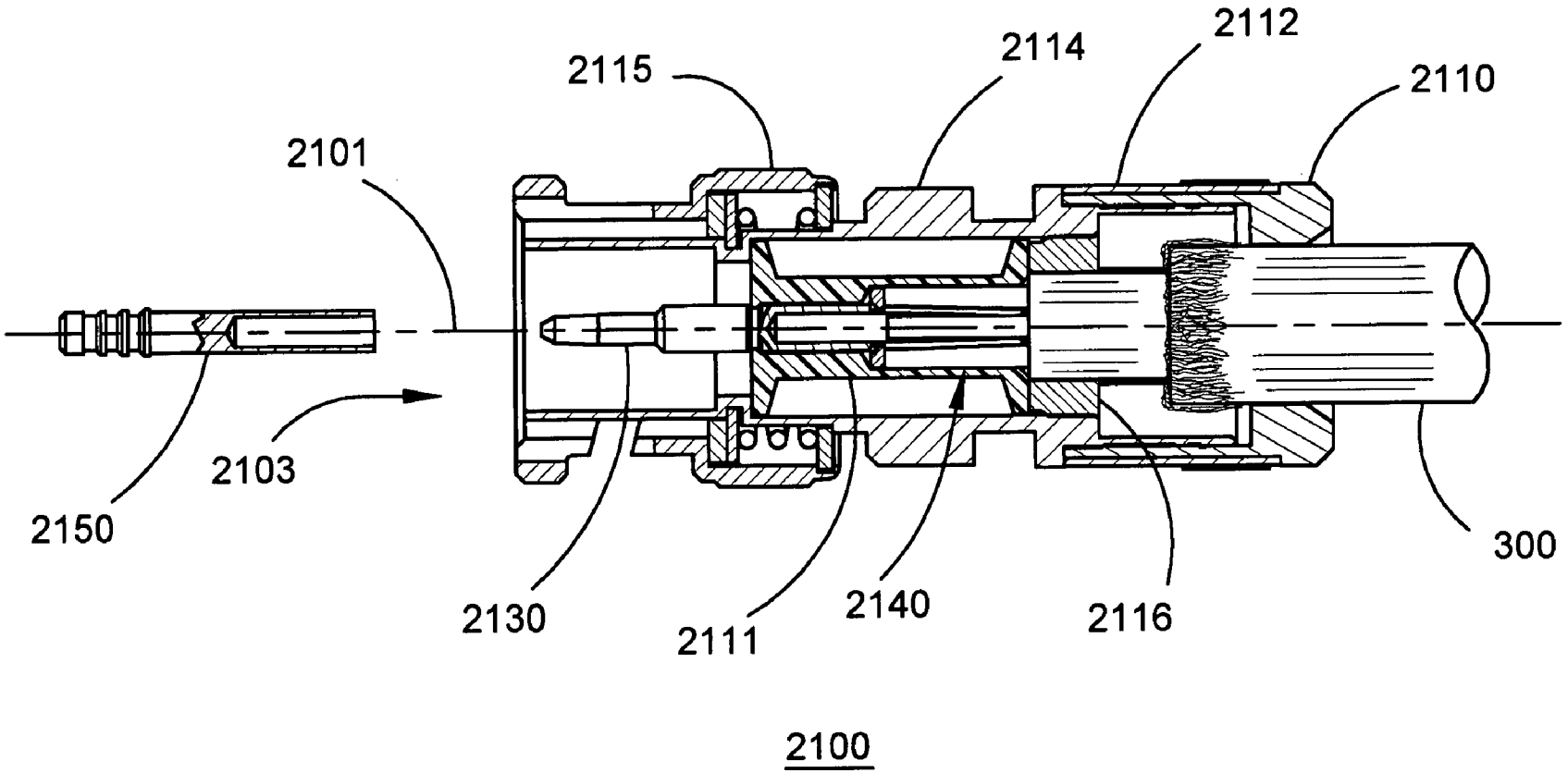
FIG. 25 is a partial cross-sectional view of the alternative embodiment of the BNC connector of FIG. 21 and a side view of the coaxial cable, fully assembled together, and with a front guide separated therefrom.

FIG. 25 is a partial cross-sectional view of the alternative embodiment of the BNC connector 2100 and a side view of the cable 300, assembled together, and with the front guide 2150 separated therefrom. In FIG. 25, the alternative embodiment of the BNC connector 2100 is shown in the "in use" state.

FIG. 26 is an enlarged cross-sectional side view of the sabot 2140 in a flared state. The sabot 2140 is made of a non-conductive material, preferably from a plastic material such as acetal. The sabot 2140 is either machined and flared, or molded in the flared or open position.

FIG. 27 is an enlarged cross-sectional side view of the sabot 2140 in a partially closed or neutral state.

FIG. 28 is an enlarged rear view of the sabot 2140 in the neutral state. The sabot 2140 comprises four (4) arms 2141–2144.

FIG. 29 is an enlarged cross-sectional side view of the sabot 2140 in a closed state.

FIG. 30 is an enlarged partial cross-sectional view of the contact assembly of the alternative embodiment of the BNC connector 2100, which comprises the sabot 2140 and the pin 2130. The contact assembly moves forward within the post 2116 as the cable 300 is inserted into the back end 2102 of the BNC connector. Flaring ensures that the sabot 2140 engages the bore of the post 2116 and keeps the pin 2130 centered in the post. The sabot 2140 snaps onto the back end of the pin 2130, which helps the pin and the sabot to stay axially engaged. The positioning of the sabot 2140 and pin 2130 reduces blind entry problems of the cable 300. The sabot 2140 is preferably slotted to allow even closure when forced into the bore of the post 2116. The arms 2141–2144 of the sabot 2140 preferably close evenly during compression and drive the four (4) fingers of the pin 2130 radially inward, causing the four fingers of the pin to close upon and to engage the center conductor 431 of the cable 300. This type of closing action provides positive electrical and mechanical contact between the pin 2130 of the BNC connector 2100 and the center conductor 431 of the cable 300. This closing action also prevents buckling of the center conductor 431 of the cable 300 because the arms 2141–2144 of the sabot 2140 do not apply a columnar load to the center conductor. The sabot 2140 is at least partially closed by the inner diameter of the post 2116. The sabot 2140 also acts as a guide for the dielectric layer 432 of the cable 300 to enter the inner diameter of the post 2116.

FIG. 31 is an enlarged cross-sectional side view of an alternative embodiment of the sabot 2160 that has an annular recess 2170 on the outside surface near the front end of the sabot. The alternative embodiment of the sabot 2160 has four arms (only arm 2161 and arm 2163 are shown). The annular recess 2170 provides a pivot point for the arms to hinge.

Figure 32:
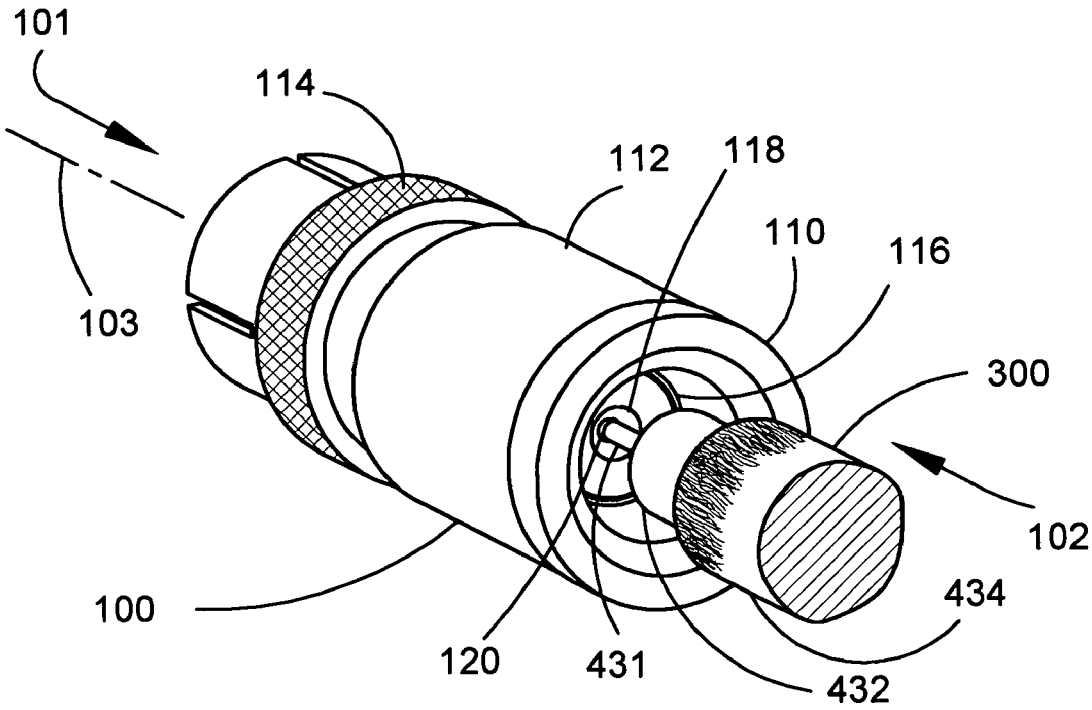
FIG. 32 is a perspective view of the RCA connector of FIG. 1 showing that a small opening at the back end of the RCA connector, into which a center conductor of the coaxial cable of FIG. 3 is to be inserted, is visible to a user during insertion of the coaxial cable.

FIG. 32 is a perspective view of the RCA connector 100 illustrating that the target 120 at the back end 102 of the RCA connector, into which the center conductor 431 of the cable 300 is to be inserted, is readily visible to a user during insertion. As the cable 300 enters the back end 102 of the RCA connector 100, the target 120 advantageously remains visible to the user until the center conductor 431 of the cable reaches the target.

Figure 33:
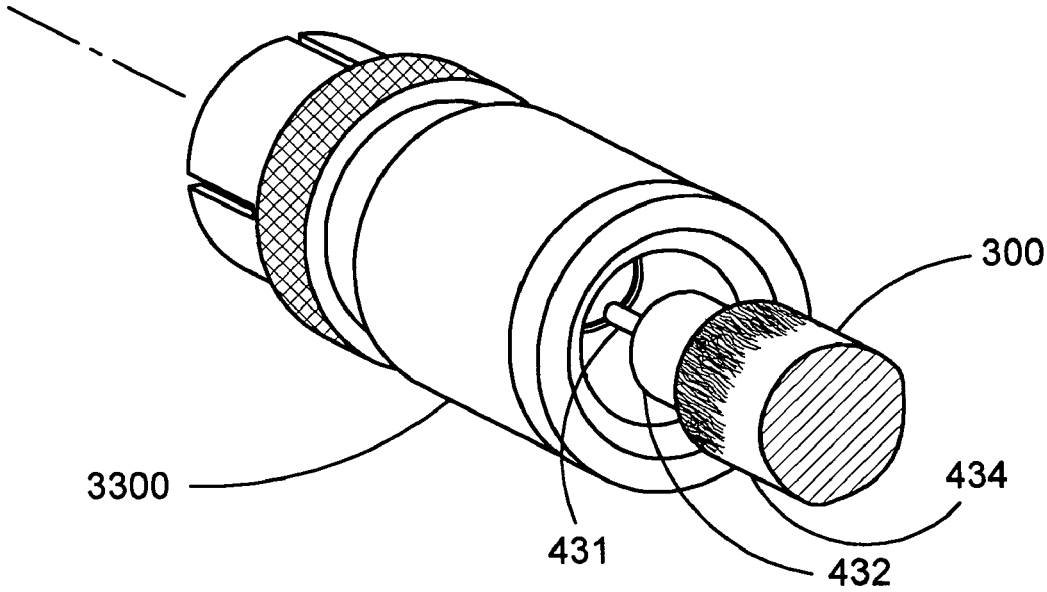
FIG. 33 Prior Art
FIG. 33 is a perspective view of a prior art RCA connector showing that a small opening at the back end of the prior art RCA connector, into which a center conductor of the coaxial cable of FIG. 3 is to be inserted, is not visible to a user during insertion of the coaxial cable.

FIG. 33 is a perspective view of a known RCA connector 3300 illustrating that a target (not shown), recessed from the back end of the known RCA connector into which the center conductor 431 of the cable 300 is to be inserted, is not readily visible to a user during insertion. The dielectric layer 432 or the jacket 434, or both the dielectric layer and the jacket, of the cable 300 block the user's view of the target before the center conductor 431 reaches the target (not shown) of the known connector 3300. Nevertheless, the user must disadvantageously continue to insert the cable 300 into the known RCA connector 3300 after the user loses sight of the target in order to continue the attachment. Because the user loses sight of the target of the known RCA connector 3300 before the center conductor 431 reaches the target, the center conductor 431 might fail to enter the target. Worse yet, the user would not be able to realize that the center conductor 431 failed to enter the target of the known RCA connector 3300 until after completion of the attachment when electrical testing of the known connector and cable combination might reveal a problem. The disadvantages of the known RCA connector 3300 set forth herein above also exist with known BNC and F connectors (not shown).

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. An electrical connector for attachment to a coaxial cable, the coaxial cable comprising a center conductor and a dielectric layer surrounding the center conductor, the electrical connector comprising:

a longitudinal axis;

a back end for receiving the coaxial cable;

a front end;

a body;

a post fixedly mounted within the body; and a contact assembly movably mounted to the post, the contact assembly comprising:

a guide, a pin fixedly mounted to the guide, the pin having a front end and a back end, wherein the back end defining a bore, and a clip mounted within the bore for making electrical and mechanical contact with the center conductor of the coaxial cable, the clip fixedly mounted to the back end of the pin;

wherein the contact assembly is capable of moving along the longitudinal axis toward the front end of the electrical connector in response to insertion of the coaxial cable into the back end of the electrical connector, wherein the front end of the pin protrudes from the body when the coaxial cable is fully inserted into the back end of the electrical connector.

2. The electrical connector of claim 1, in which a back side of the guide has an opening at the longitudinal axis for receiving the center conductor of the coaxial cable.

3. The electrical connector of claim 2, in which the back side of the guide is funnel-shaped to guide the center conductor of the coaxial cable toward the opening in the guide.

4. The electrical connector of claim 2, in which the dielectric layer of the coaxial cable moves the contact assembly.

5. The electrical connector of claim 2, in which the opening in the guide is viewable to a user during attachment until the center conductor of the coaxial cable enters the opening.

6. The electrical connector of claim 1, in which a back side of the guide is funnel-shaped with an opening at the longitudinal axis for receiving the center conductor of the coaxial cable, such that the dielectric layer, and not the center conductor, of the coaxial cable moves the contact assembly.

7. An axially compressible connector for attachment to a coaxial cable, the coaxial cable comprising a center conductor and a dielectric layer surrounding the center conductor, the axially compressible connector comprising:

a longitudinal axis;

a back end for receiving the coaxial cable;

a front end;

a body;

a post fixedly mounted within the body; and a contact assembly movably mounted within the post, the body, the post and the contact assembly having a common longitudinal axis; the contact assembly comprising:

a guide, a pin fixedly mounted to the guide, the pin having a front end and a back end, wherein the back end defining a bore, and a clip mounted within the bore for making electrical and mechanical contact with the center conductor of the coaxial cable, the clip fixedly mounted to the back end of the pin;

wherein the contact assembly is capable of longitudinally moving toward the front end of the electrical connector, such that the front end of the pin moves from a first position completely within the body to a second position at least partially protruding from the front end of the body, in response to insertion of the coaxial cable into the back end of the RCA connector.

8. The axially compressible connector of claim 7, in which a back side of the guide has an opening at the longitudinal axis for receiving the center conductor of the coaxial cable.

9. The axially compressible connector of claim 8, in which the back side of the guide is funnel-shaped to guide the center conductor of the coaxial cable toward the opening in the guide.

10. The axially compressible connector of claim 8, in which the dielectric layer of the coaxial cable moves the contact assembly.

11. The axially compressible connector of claim 8, in which the opening in the guide is viewable to a user during attachment until the center conductor of the coaxial cable enters the opening.

12. The axially compressible connector of claim 7, in which a back side of the guide is funnel-shaped with an opening at the longitudinal axis for receiving the center conductor of the coaxial cable, such that the dielectric layer, and not the center conductor, of the coaxial cable moves the contact assembly.

* * * * *